US010152866B2

(12) United States Patent
Kraz et al.

(10) Patent No.: US 10,152,866 B2
(45) **Date of Patent: *Dec. 11, 2018**

(54) HAZARD DETECTOR ARCHITECTURE FACILITATING COMPACT FORM FACTOR AND MULTI-PROTOCOL WIRELESS CONNECTIVITY

(71) Applicant: Google LLC, Mountain View, CA (US)

(72) Inventors: Mark Kraz, Santa Clara, CA (US); Adam Mittleman, Redwood City, CA (US); Nicholas Unger Webb, Menlo Park, CA (US); Andrew W. Goldenson, Palo Alto, CA (US); Ian Charles Smith, Mountain View, CA (US); Daniel Adam Warren, San Francisco, CA (US); Mikko Sannala, Los Gatos, CA (US)

(73) Assignee: Google LLC, Mountain View, CA (US)

( * ) Notice: Subject to any disclaimer, the term of this patent is extended or adjusted under 35 U.S.C. 154(b) by 142 days.

This patent is subject to a terminal disclaimer.

(21) Appl. No.: 15/255,502

(22) Filed: Sep. 2, 2016

(65) Prior Publication Data

US 2016/0371949 A1 Dec. 22, 2016

Related U.S. Application Data

(63) Continuation of application No. 14/714,048, filed on May 15, 2015, now Pat. No. 9,466,194.

(51) Int. Cl.
*G08B 1/00* (2006.01)
*G08B 17/10* (2006.01)
(Continued)

(52) U.S. Cl.
CPC ..... *G08B 17/10* (2013.01); *G08B 3/10* (2013.01); *G08B 17/113* (2013.01); *G08B 21/14* (2013.01);
(Continued)

(58) Field of Classification Search
CPC ..... G08B 3/10; G08B 29/18
(Continued)

(56) References Cited

U.S. PATENT DOCUMENTS 6,753,786 B1 6/2004 Apperson et al.
8,847,772 B2 9/2014 Marks et al.
9,466,194 B1 * 10/2016 Kraz ..... G08B 17/10

FOREIGN PATENT DOCUMENTS

WO 2016/186868 A1 11/2016

OTHER PUBLICATIONS

International Search Report and Written Opinion dated Jun. 9, 2016, for International Patent Application No. PCT/US2016/031192, 6 pages.

(Continued)

*Primary Examiner* — Daryl Pope
(74) *Attorney, Agent, or Firm* — Kilpatrick Townsend & Stockton LLP

(57) ABSTRACT

Systems, methods, and devices for hazard detection are described. A hazard detection device may include a printed circuit board. The hazard detection device may further include a chassis that provides a housing for components of the hazard detection device; a smoke chamber that is mid-mounted; a carbon monoxide sensor that is mounted with the circuit board; and a speaker assembly that partially encircles the mid-mounted smoke chamber.

20 Claims, 26 Drawing Sheets

(51) Int. Cl.

| | |
|---|---|
| ***G08B 17/113*** | (2006.01) |
| ***G08B 21/14*** | (2006.01) |
| ***G08B 29/18*** | (2006.01) |
| ***G08B 3/10*** | (2006.01) |
| *G08B 25/10* | (2006.01) |
| *G08B 29/16* | (2006.01) |

(52) U.S. Cl.
CPC ..... *G08B 29/18* (2013.01); *G08B 25/10* (2013.01); *G08B 29/16* (2013.01)

(58) Field of Classification Search
USPC ..... 340/540, 539.1, 628, 629, 630, 632, 340/693.5, 693.6
See application file for complete search history.

(56) References Cited

OTHER PUBLICATIONS

International Preliminary Report on Patentability of PCT/US2016/031192 dated Nov. 30, 2017, all pages.

* cited by examiner

1700

HAZARD DETECTOR ARCHITECTURE FACILITATING COMPACT FORM FACTOR AND MULTI-PROTOCOL WIRELESS CONNECTIVITY

CROSS-REFERENCES TO RELATED APPLICATIONS

This application is a continuation of U.S. patent application Ser. No. 14/714,048, filed May 15, 2015, entitled "HAZARD DETECTOR ARCHITECTURE FACILITATING COMPACT FORM FACTOR AND MULTI-PROTOCOL WIRELESS ACTIVITY", the entire disclosure of which is hereby incorporated by reference for all purposes.

1. THE FIELD OF THE INVENTION

The present invention generally relates to configurations of various components of a hazard detection device with respect to a circuit board.

2. BACKGROUND

In some forms of hazard detection devices it may be beneficial to include multiple sensors for detecting a variety of hazardous situations. Close proximity between such sensors and additional components of the device can prove problematic due to electrical interference. Such electrical interference concerns may need to be considered when determining component placement in relation to a circuit board of the device.

SUMMARY

In accordance with the teachings provided herein, devices and methods are provided for improving the accuracy and the efficiency of various components of a hazard detection device with respect to placement of such components with respect to a circuit board of the device.

For example, a hazard detection device may comprise a printed circuit board. The hazard detection device may further comprise a chassis that provides a housing for components of the hazard detection device. The hazard detection device may further comprise a smoke chamber, mounted to the printed circuit board, the smoke chamber at least partially housing a photoelectric diode. The hazard detection device may further comprise a carbon monoxide sensor, mounted to the printed circuit board, the carbon monoxide sensor at least partially encased in a metallic covering. The hazard detection device may further comprise a first wireless interface component, mounted to the printed circuit board, the first wireless interface component comprising a first radio antenna configured to transmit and receive data according to a first wireless communication protocol, wherein the first wireless interface component is mounted to the printed circuit board within a distance of 31 millimeters in relation to the carbon monoxide sensor. The hazard detection device may further comprise a second wireless interface component, mounted to the printed circuit board, the second wireless interface component comprising a second radio antenna configured to transmit and receive data using a second wireless communication protocol, wherein the second wireless interface component is mounted to the printed circuit board within a distance of 14 millimeters in relation to the carbon monoxide sensor.

In another example, a system for hazard detection may comprise a printed circuit board. The system may further comprise a means for housing components of a hazard detection device. The system may further comprise a means for sensing smoke that is mounted to the printed circuit board, the means for sensing smoke at least partially housing a photoelectric diode. The system may further comprise a means for sensing carbon monoxide that is mounted to the printed circuit board, the means for sensing carbon monoxide at least partially encased in a metallic covering. The system may further comprise a means for receiving first data, the means for receiving the first data being configured to transmit and receive the first data according to a first wireless communication protocol, and the means for receiving the first data being mounted to the printed circuit board within a distance of 31 millimeters in relation to the means for sensing carbon monoxide. The system may further comprise a means for receiving second data, the means for receiving the second data being configured to transmit and receive the first data according to a second wireless communication protocol, and the means for receiving the second data being mounted to the printed circuit board within a distance of 14 millimeters in relation to means for sensing carbon monoxide.

In yet a further example, a method for manufacturing a hazard detection device may comprise providing a printed circuit board mounting a smoke chamber to the printed circuit board, the smoke chamber at least partially housing a photoelectric diode. The method may further comprise mounting a carbon monoxide sensor to the printed circuit board, the carbon monoxide sensor at least partially encased in a metallic covering. The method may further comprise mounting a first wireless interface component to the printed circuit board, the first wireless interface component comprising a first radio antenna configured to transmit and receive data according to a first wireless communication protocol, wherein the first wireless interface component is mounted to the printed circuit board within a distance of 31 millimeters in relation to the carbon monoxide sensor. The method may further comprise mounting a second wireless interface component to the printed circuit board, the second wireless interface component comprising a second radio antenna configured to transmit and receive data using a second wireless communication protocol, wherein the second wireless interface component is mounted to the printed circuit board within a distance of 14 millimeters in relation to the carbon monoxide sensor. The method may further comprise attaching a chassis to the printed circuit board, the chassis providing a housing for components of the hazard detection device.

In the systems, methods, and devices described herein, a photoelectric diode included in the smoke chamber may be encased in an additional metallic covering. Additionally, the first wireless interface component and the second wireless interface component may be mounted to the printed circuit board within a distance of 74.04 millimeters in relation to a center of the smoke chamber.

In the systems, methods, and devices described herein, the additional metallic covering may comprise a conductive cap, a conductive base, and a conductive cylindrical mesh that encircles the smoke chamber.

In the systems and devices described herein, the chassis may comprise a front surface comprising an inner portion defining a chassis central aperture, and the front surface may have a domed contour.

In the systems and devices described herein, a gap between the chassis and the printed circuit board may decrease at points approaching a shared edge of the chassis and the printed circuit board according to a taper of the inner portion.

In the systems, methods, and devices described herein, the carbon monoxide sensor may be coupled to a mounting bracket comprising a plurality of mounting points. The mounting bracket may be coupled to the printed circuit board at the plurality of mounting points such that an acute angle is formed between an outer exterior of the carbon monoxide sensor and a plane of the printed circuit board.

In the systems, methods, and devices described herein, the acute angle may be formed by partially depressing one or more mounting points of the carbon monoxide sensor into a cutout in the printed circuit board.

In the systems, methods, and devices described herein, the carbon monoxide sensor may be mounted at the acute angle with respect to the circuit board so as to fit in a cutout between the chassis and the printed circuit board when the chassis is coupled to the printed circuit board.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
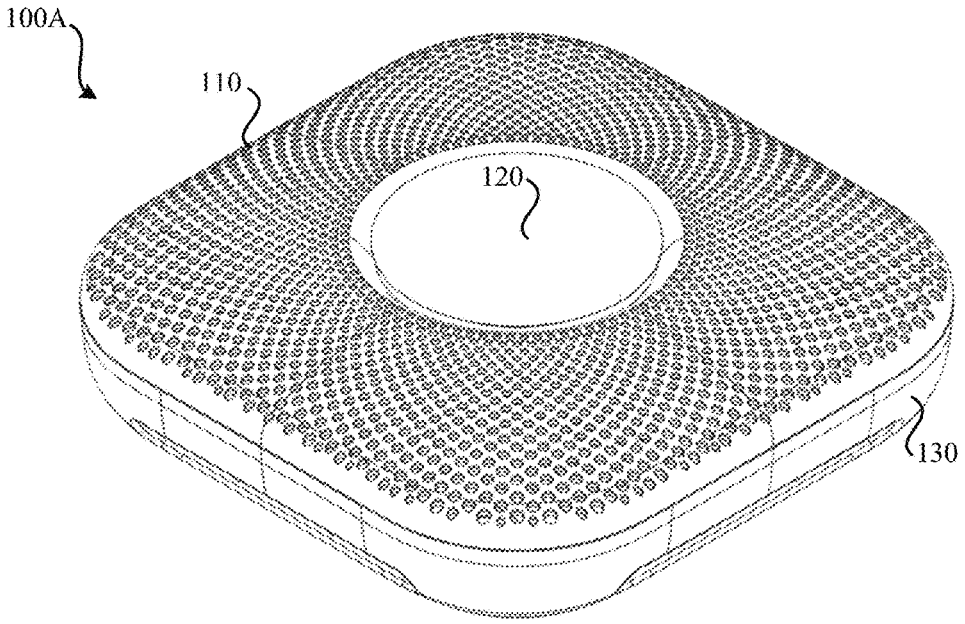
FIGS. 1A and 1B illustrate an embodiment of a smart combined smoke detector and carbon monoxide device.

A hazard detection device, for example, one that includes a smoke detector and/or carbon monoxide detector, may provide a user a sense of security. Ideally, such a device may be configured to provide a wide range of functionality while requiring a minimal amount of space. Other components of such a device may interfere with hazard detection sensors. For example, the device may include various wireless interfaces that use wireless protocols that may electronically interfere with a smoke detector or carbon monoxide detector. This interference may cause inaccurate readings by optical smoke and carbon monoxide (CO) sensors thus causing "false alarms" to be sounded or legitimate hazards to go undetected. At best, inaccuracy may lead to user frustration and annoyance. At worse, such inaccurate readings may lead to property damage and loss of life.

A hazard detection device may be ideally configured to allow for a variety of components (e.g., a smoke detector, a CO sensor, a Bluetooth antenna, a wireless antenna, a relative humidity and temperature sensor, and the like) to operate accurately. Arrangements presented herein are focused on minimizing electronic interference between components while simultaneously providing such components within a minimal amount of space. For example, a hazard detection device may include a printed circuit board to which a variety of components may be mounted. Configuration disclosed here may allow a domed chassis to be fitted to a circuit board such that the components mounted to the circuit board are encased.

In some cases, the configuration of a component on the printed circuit board may provide additional advantages. For example, a buzzer of a hazard detection device may have various safety requirements that require sound emanating from the buzzer to be greater than a threshold decibel level. The buzzer may be mounted to a printed circuit board and encased by a chassis such that the sound emanating from the buzzer may be amplified.

In at least one embodiment, sensors (e.g., a smoke detector or carbon monoxide detector) may each be encased in a faraday cage. Each faraday cage may individual decrease electromagnetic noise that affects the sensors. Ideally, such sensors and the corresponding faraday cages may be mounted on the printed circuit board in such a way as to allow for a chassis to be fitted over the components and attached to the printed circuit board. Encasing a number of sensors in individual faraday cages may enable various components of the hazard detection device to operate in close proximity, without negatively impacting the operations of each component. Thus, a hazard detection device may be designed to provide a more compact presentation.

Various embodiments of configurations disclosed herein may allow for a sensor, such as a relative humidity and temperature (RHT) sensor, to be located on a printed circuit board so as to minimize heat transfer from the board and other components to the RHT sensor. Thus, such isolation of the RHT sensor may allow for greater reading accuracy of room temperature and humidity.

In at least one embodiment, a custom connector may be utilized in order to provide an optimal wire gauge. For example, the custom connector may be connected to a number (e.g., six) batteries used to operate the device if electrical power is otherwise unavailable. A custom connector may be designed to provide a low wire gauge in order to optimize battery usage. Utilizing a lower wire gauge increases the diameter of the wire resulting in less resistance for electrical current to meet. Thus, a wire that has less resistance may be utilized to provide longer battery life than a wire having greater resistance.

Various embodiments of configurations disclosed herein may include a speaker for producing sound from an electrical signal. Embodiments of the speaker included herein may be mounted on a circuit board such that speaker may be encased by, for example, a domed chassis. The speaker may be designed so as to maximize spatial efficiency with respect to the circuit board.

Various embodiments of hazard detection devices, including the above aspects and aspects yet to be noted, are described in detail in relation to the figures that follow. For overall understanding, a big picture view of a hazard detection device is first described. Such a hazard detection device may be a dedicated smoke detector or a combination device, such as carbon-monoxide detector and smoke detector. FIG. 1A illustrates an embodiment of a smart combined smoke detector and carbon monoxide device 100A. Such an embodiment of a smart combined smoke detector and carbon monoxide device 100A may be suitable for mounting to a wall or ceiling in a room (or other location) within a structure in which smoke and/or carbon monoxide is to be monitored. Device 100A may be "smart," meaning the device 100A can communicate, likely wirelessly, with one or more other devices or networks. For instance, device 100A may communicate with a remote server via the Internet and, possibly, a home wireless network (e.g., an IEEE 802.11a/b/g network, 802.15 network, such as using the Zigbee® or Z-wave® specification). Such a smart device may allow for a user to interact with the device via wireless communication, either via a direct or network connection between a computerized device (e.g., cellular phone, tablet computer, laptop computer, or desktop computer) and the smart device.

FIG. 1A illustrates an angular top projection view of combined smoke detector and carbon monoxide device 100A. Device 100A may generally be square or rectangular and have rounded corners. Visible in the angular top projection view are various components of the combined smoke detector and carbon monoxide device 100A, including: cover grille 110, lens/button 120, and enclosure 130 (also referred to as sensor housing 130). Cover grille 110 may serve to allow air to enter combined smoke detector and carbon monoxide device 100A through many holes while giving device 100A a pleasing aesthetic appearance. Cover grille 110 may further serve to reflect light into the external environment of device 100A from internal lighting elements (e.g., LEDs). Light may be routed internally to cover grille 110 by a light guide, noted in relation to FIGS. 2A, 2C, and 2D. It should be understood that the arrangement of holes and shape of cover grille 110 may be varied by embodiment. Lens/button 120 may serve multiple purposes. First, lens/button 120 may function as a lens, such as a Fresnel lens, for use by a sensor, such as an infrared (IR) sensor, located within device 100A behind lens/button 120 for viewing the external environment of device 100A. Additionally, lens/button 120 may be actuated by a user by pushing lens/button 120. Such actuation may serve as user input to device 100A. Enclosure 130 may serve as a housing for at least some of the components of device 100A.

Figure 1B:
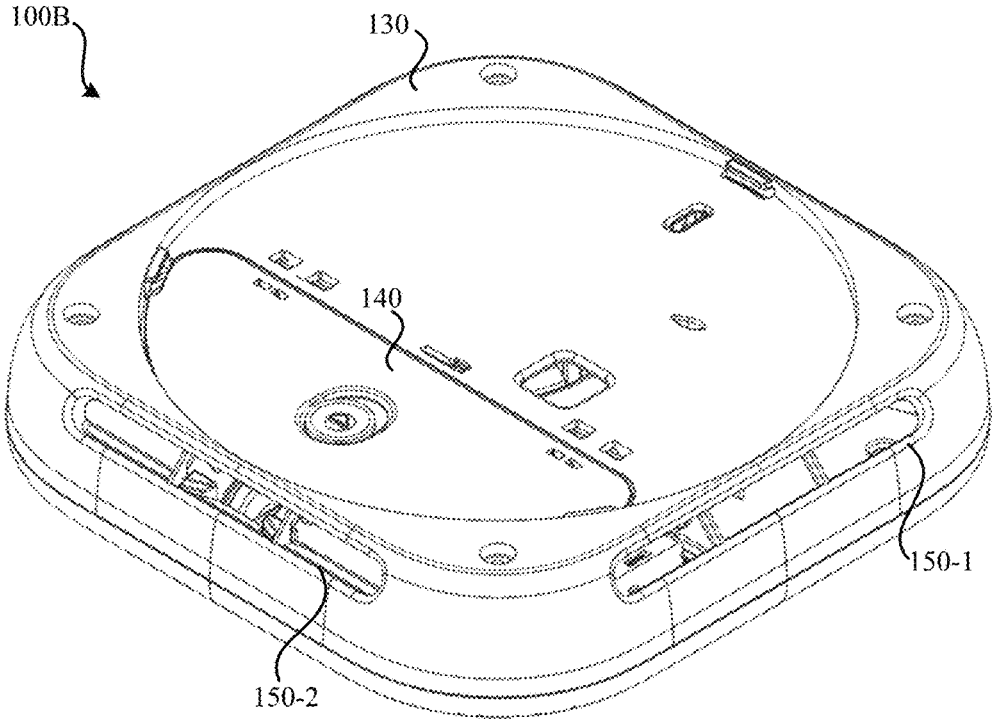

FIG. 1B illustrates an angular bottom projection view of a smart combined smoke detector and carbon monoxide device 100B. It should be understood that device 100A and device 100B may be the same device viewed from different angles. Visible from this view is a portion of enclosure 130. On enclosure 130, battery compartment door 140 is present through which a battery compartment is accessible. Also visible are airflow vents 150-1 and 150-2, which allow air to pass through enclosure 130 and enter the smoke chamber of device 100B.

Figure 2A:
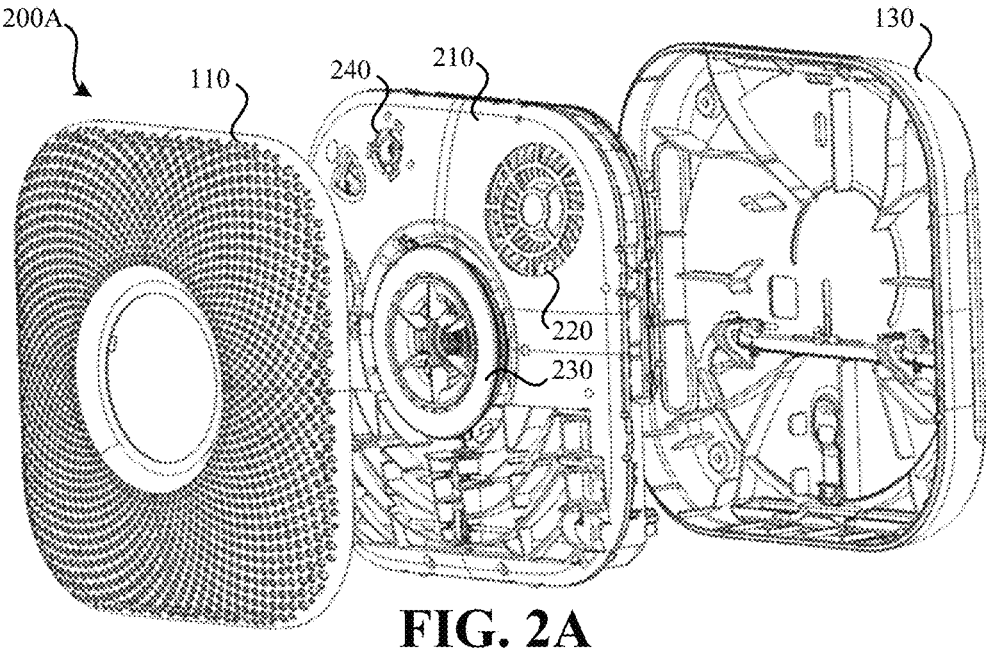
FIGS. 2A, 2B, 2C, and 2D illustrate an embodiment of an exploded smart combined smoke detector and carbon monoxide device.
Figure 2B:
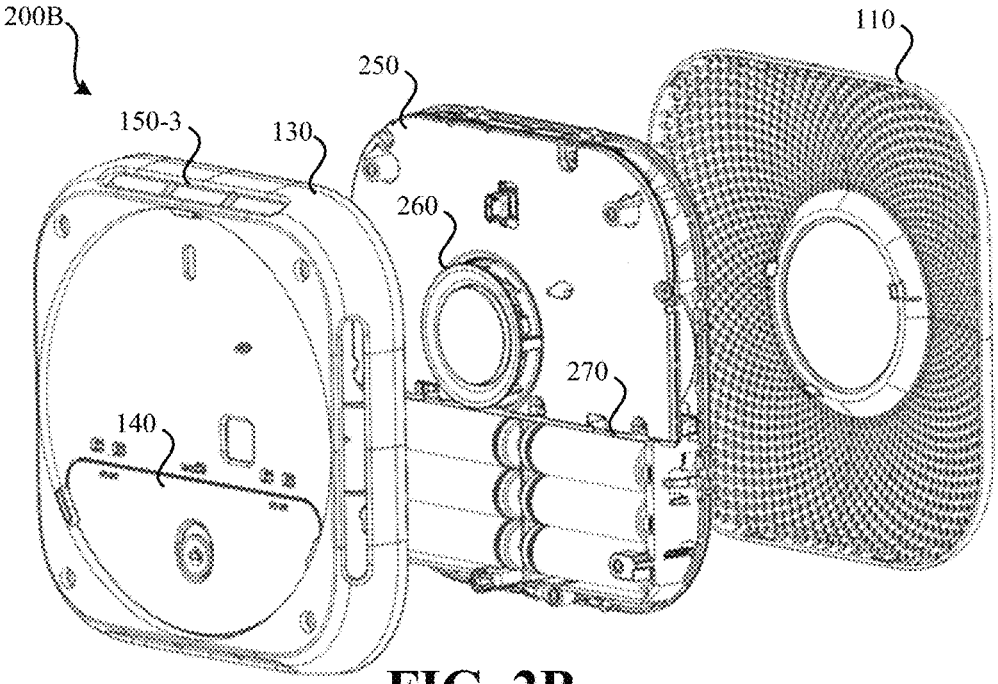

FIGS. 2A, 2B, 2C, and 2D illustrate an embodiment of an exploded smart combined smoke detector and carbon monoxide device. The devices of FIGS. 2A-2D can be understood as representing various views of devices 100A and 100B of FIGS. 1A and 1B, respectively. In FIG. 2A, device 200A is shown having cover grille 110 and enclosure 130, which together house main chassis 210. Main chassis 210 may house various components that can be present in various embodiments of device 200A, including speaker 220, light guide 230, and microphone 240. FIG. 2B of an embodiment of device 200B can be understood as illustrating the same device of FIG. 2A, from a different viewpoint. In FIG. 2B, cover grille 110, enclosure 130, airflow vent 150-3, and battery compartment door 140 are visible. Additionally visible is cover 250, which forms a shield between an underlying circuit board and enclosure 130. Protruding through cover 250 is smoke chamber 260. A gap may be present between enclosure 130 and main circuit board 288 to allow airflow through airflow vents 150 to have a relatively unobstructed path to enter and exit smoke chamber 260. Also present in FIG. 2B are multiple batteries, which are installed within battery compartment 270 of device 200B and which are accessible via battery compartment door 140. Some or all components on main circuit board 288 may be at least partially covered by one or more laminar flow covers (e.g., laminar flow cover 250). Such laminar flow covers can help laminar air flow within the device and prevent a user from inadvertently touching a component that could be sensitive to touch, such as via electro-static discharge.

Figure 2C:
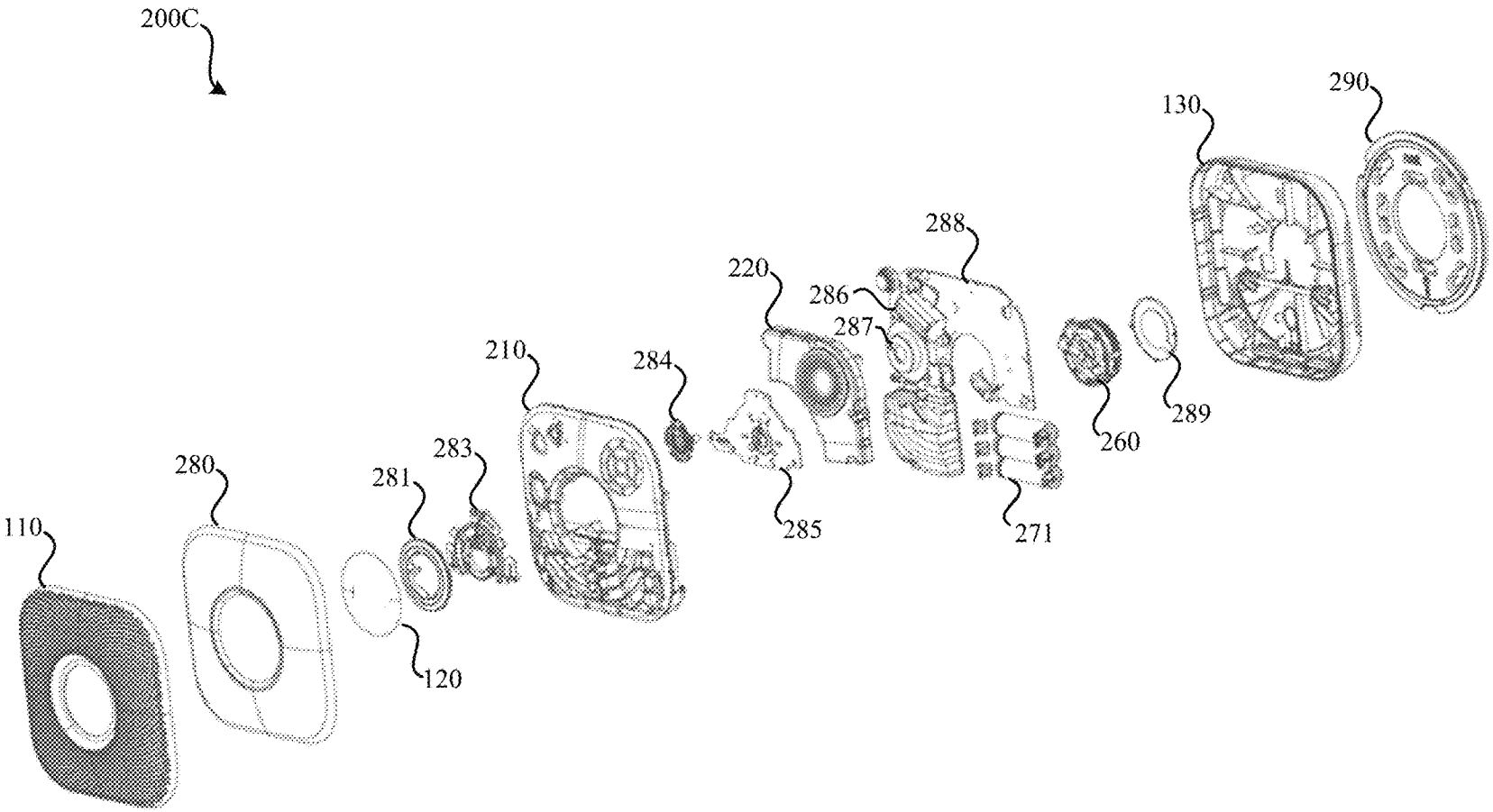

FIG. 2C represents a more comprehensive exploded view of a smart combined smoke detector and carbon monoxide detector device 200C. Device 200C may represent an alternate view of devices 100A, 100B, 200A, and 200B. Device 200C may include: cover grille 110, mesh 280, lens/button 120, light guide 281, button flexure 283, main chassis 210, diaphragm 284, passive infrared (PIR) and light emitting diode (LED) daughterboard 285, speaker 220, batteries 271, carbon monoxide (CO) sensor 286, buzzer 287, main circuit board 288, smoke chamber 260, chamber shield 289, enclosure 130, and surface mount plate 290. It should be understood that alternate embodiments of device 200C may include a greater number of components or fewer components than presented in FIG. 2C.

A brief description of the above-noted components that have yet to be described follows: Mesh 280 sits behind cover grille 110 to obscure external visibility of the underlying components of device 200C while allowing for airflow through mesh 280. Mesh 280 and cover grille 110 can help CO more readily enter the interior of the device, where CO sensor 286 is located. Light guide 281 serves to direct light generated by lights (e.g., LEDs such as the LEDs present on daughterboard 285) to the external environment of device 200C by reflecting off of a portion of cover grille 110. Button flexure 283 serves to allow a near-constant pressure to be placed by a user on various locations on lens/button 120 to cause actuation. Button flexure 283 may cause an actuation sensor located off-center from lens/button 120 to actuate in response to user-induced pressure on lens/button 120. Diaphragm 284 may help isolate the PIR sensor on daughterboard 285 from dust, bugs, and other matter that may affect performance. Daughterboard 285 may have multiple lights (e.g., LEDS) and a PIR (or other form of sensor). Daughterboard 285 may be in communication with components located on main circuit board 288. The PIR sensor or other form of sensor on daughterboard 285 may sense the external environment of device 200C through lens/button 120.

Buzzer 287, which may be activated to make noise in case of an emergency (and when testing emergency functionality), and CO sensor 286 may be located on main circuit board 288. Main circuit board 288 may interface with one or more batteries 271, which serve as either the primary source of power for the device or as a backup source of power if another source, such as power received via a wire from the grid, is unavailable. Protruding through main circuit board may be smoke chamber 260, such that air (including smoke if present in the external environment) passing into enclosure 130 is likely to enter smoke chamber 260. Smoke chamber 260 may be capped by chamber shield 289, which may be conductive (e.g., metallic). Smoke chamber 260 may be encircled by a conductive (e.g., metallic) mesh (not pictured). Enclosure 130 may be attached and detached from surface mount plate 290. Surface mount plate 290 may be configured to be attached via one or more attachment mechanism (e.g., screws or nails) to a surface, such as a wall or ceiling, to remain in a fixed position. Enclosure 130 may be attached to surface mount plate 290 and rotated to a desired orientation (e.g., for aesthetic reasons). For instance, enclosure 130 may be rotated such that a side of enclosure 130 is parallel to an edge of where a wall meets the ceiling in the room in which device 200C is installed.

Figure 2D:
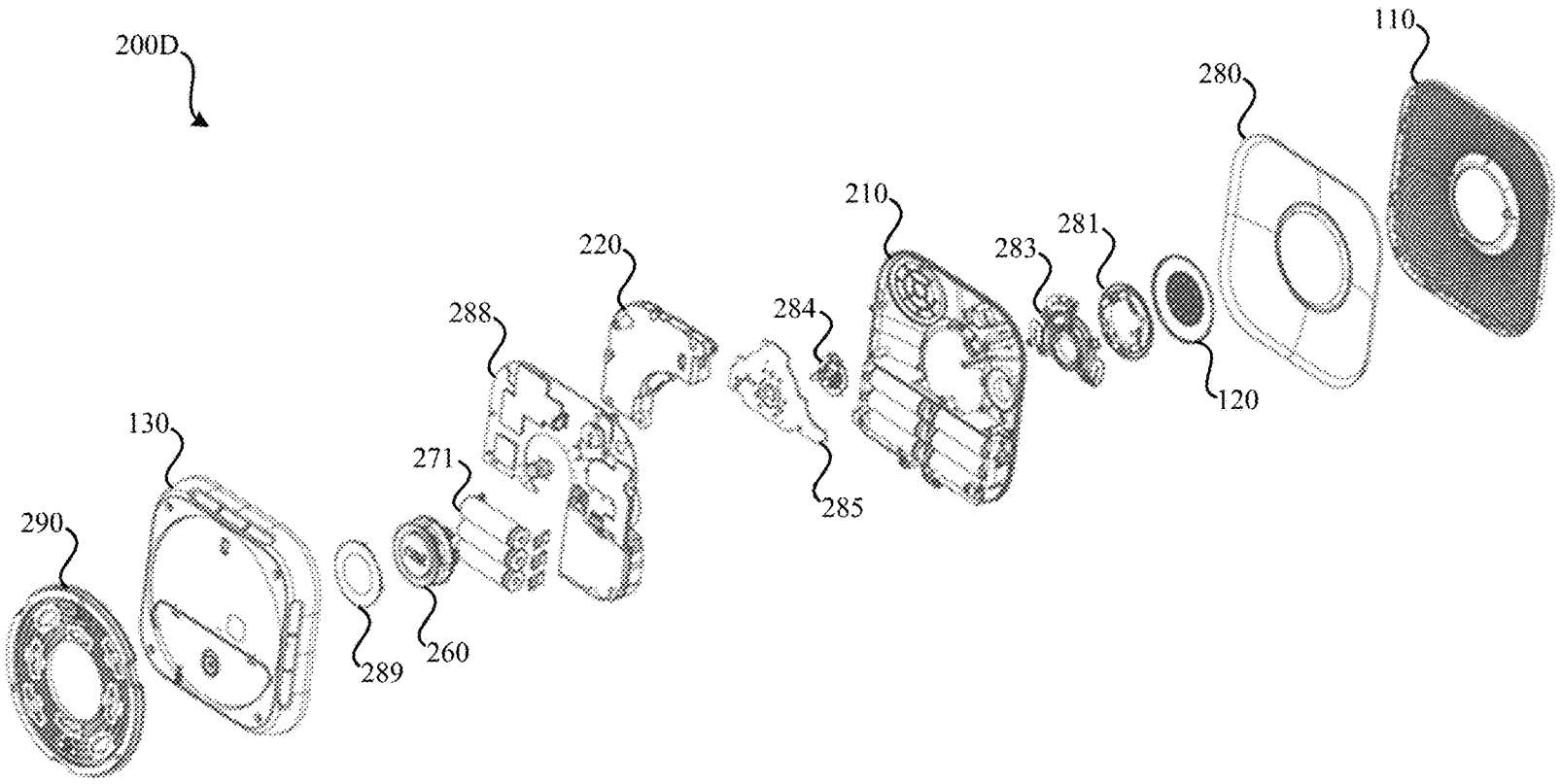

FIG. 2D represents the comprehensive exploded view of the smart combined smoke detector and carbon monoxide detector device of FIG. 2C viewed from a reverse angle as presented in FIG. 2C. Device 200D may represent an alternate view of devices 100A, 100B, 200A, 200B, and 200C. Device 200D may include: cover grille 110, mesh 280, lens/button 120, light guide 281, button flexure 283, main chassis 210, diaphragm 284, passive infrared (PIR) and light emitting diode (LED) daughterboard 285, batteries 271, speaker 220, CO sensor 286, buzzer 287, main circuit board 288, smoke chamber 260, chamber shield 289, enclosure 130, and surface mount plate 290. It should be understood that alternate embodiments of device 200D may include a greater number of components or fewer components than presented in FIG. 2C.

Figure 3A:
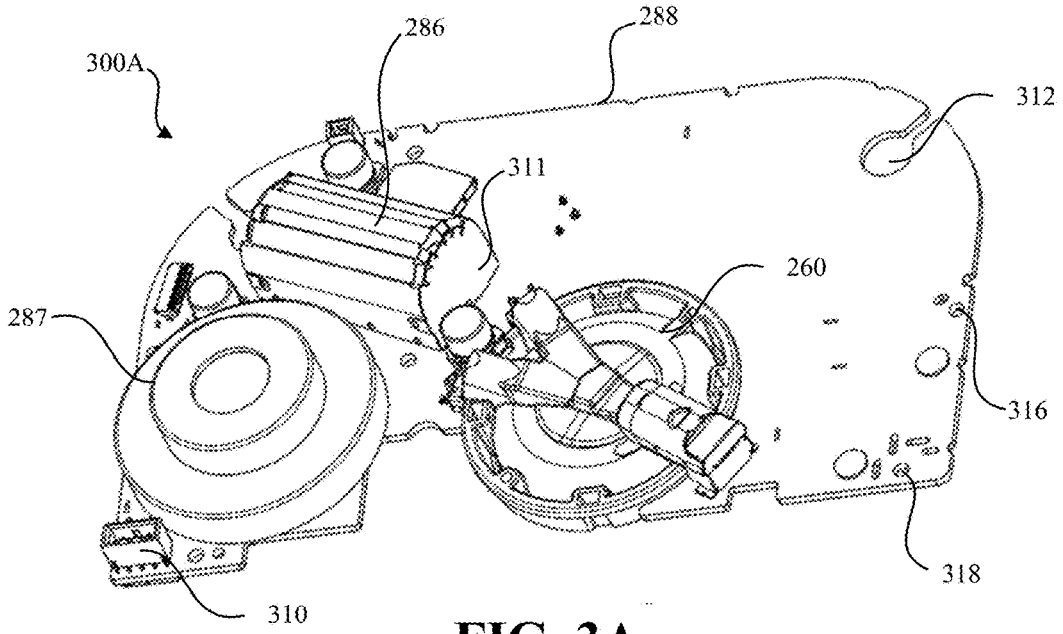
FIG. 3A illustrates an top angled view of an embodiment of a configuration of various components mounted to a printed circuit board.

FIG. 3A illustrates an angled top view of an embodiment of a configuration of various components on a printed circuit board (e.g., a printed circuit board of a smart combined smoke detector and carbon monoxide device). It should be understood that device 300A may be the same device as the main circuit board 288 of FIG. 2 as viewed from a different angle. Device 300A may include: main circuit board 288, CO sensor 286, faraday cage cap 311, smoke chamber 260 (with or without chamber shield 289 of FIG. 2), buzzer 287, custom connector 310, cutout 312, attachment interface 316, and attachment interface 318. Attachment interfaces, as included herein, are intended to individually include an opening used for the purposes of attachment (e.g., a screw hole, a nail hole, accommodate another type of fastener, or the like). It should be understood that alternate embodiments of device 300A may include a greater number of components or fewer components than presented in FIG. 3A.

Main circuit board 288 may more generally be understood to be a printed circuit board (PCB) that mechanically supports and electrically connects electronic components using conductive tracks, pads, and other features etched from copper sheets laminated onto a non-conductive substrate. In at least one embodiment, main circuit board 288 may be 1.19 mm to 1.35 mm in thickness. Said thickness may include exposed copper features (or other forms of conductive features) of the main circuit board 288. Main circuit board 288 may interface with one or more batteries via custom connector 310. Such batteries may be housed within main chassis 210. Cutout 312 may serve as an interface for connecting a speaker or other component to main circuit board 288. Attachment interfaces 316 and 318 may each serve as a point at which a fastener (e.g., a screw or nail), or other form of attachment mechanism, may be used to attach another device or component to the circuit board. One or more of the attachment mechanisms may additionally, or alternatively, be used to attach main circuit board to other portions of the hazard detector devices (e.g., enclosure 130). One or more of the attachment mechanisms may additionally, or alternatively, be used to attach other portions of the hazard detector device (e.g., main chassis 210) to the main circuit board 288.

In accordance with at least one embodiment, main circuit board 288 may include a CO sensor or other means for sensing carbon monoxide. A means for sensing carbon monoxide (e.g., CO sensor 286) may include an opto-chemical reaction, a biomimetic sensor, an electrochemical fuel cell, a semiconductor, or any suitable mechanism for sensing carbon monoxide. In accordance with at least one embodiment, CO sensor 286 may be covered by faraday cage cap 311.

In accordance with at least one embodiment, main circuit board 288 may include a smoke chamber or other means for sensing smoke. A means for sensing smoke (e.g., smoke chamber 260), as used herein, may include various smoke detection technologies, including, but not limited to ionization smoke detection and photoelectric smoke detection.

Figure 3B:
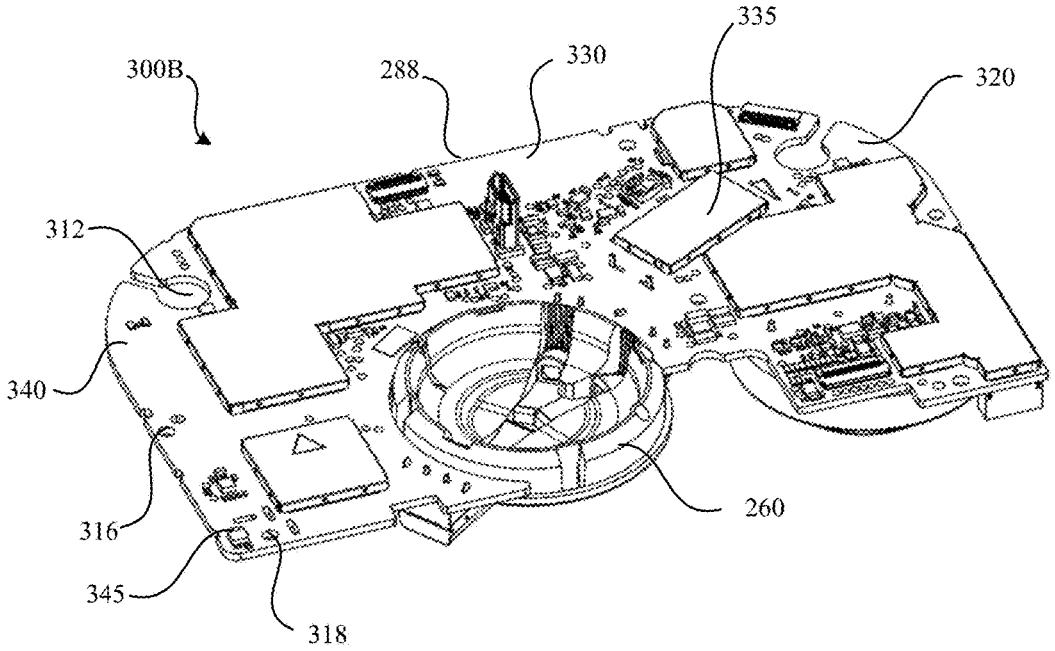
FIG. 3B illustrates an bottom angled view of an embodiment of a configuration of various components mounted to the printed circuit board.

FIG. 3B illustrates an bottom angled view of an embodiment of a configuration of various components on a printed circuit board (e.g., a printed circuit board of a smart combined smoke detector and carbon monoxide device). It should be understood that device 300B may be the same device as the main circuit board 288 of FIGS. 2C and 2D, and device 300A of FIG. 3, as viewed from another angle. Device 300B may include: cutout 312, attachment interface 316, and attachment interface 318, smoke chamber 260 (with or without chamber shield 289 of FIG. 2), wireless interface component 320, wireless interface component 330, faraday cage backing 335, wireless interface component 340, and relative humidity and temperature (RHT) sensor 345. It should be understood that alternate embodiments of device 300B may include a greater number of components or fewer components than presented in FIG. 3B.

Wireless interface component 320 (e.g., a means of receiving data) may include a short-range wireless antenna capable of transmitting and receiving information using a Bluetooth communications protocol (e.g., asynchronous connection-less (ACL) protocol, link manager protocol, low energy security manager protocol, or the like) to communicate with a Bluetooth-enabled device (e.g., a smart phone, laptop, tablet, or other smart device). Accordingly, a user may interact with a hazard detection device via Bluetooth communication between a computerized device (e.g., cellular phone, tablet computer, laptop computer, or desktop computer).

Wireless interface component 330 (e.g., a means of receiving data) may be utilized to communicate with a remote server via the Internet and, possibly, a home wireless network (e.g., an IEEE 802.11a/b/g or 802.15 network, using for example the Zigbee® or Z-wave® specification). Accordingly, user may interact with the hazard detection device via wireless communication, either via a direct or network connection between a computerized device (e.g., cellular phone, tablet computer, laptop computer, or desktop computer) and the smart device.

Wireless interface component 340 may be utilized to communicate with a remote server via the Internet and, possibly, a home wireless network (e.g., 802.15 network, using for example an IPv6 over Low-power Wireless Personal Area Networks specification). Accordingly, user may interact with the hazard detection device via wireless communication, either via a direct or network connection between a computerized device (e.g., cellular phone, tablet computer, laptop computer, or desktop computer) and the smart device.

In accordance with at least one embodiment, RHT sensor 345 may include a capacitive sensor, a resistive sensor, a psychrometer sensor, a hygrometer sensor, or any suitable sensor capable of sensing relative humidity and/or temperature.

In accordance with at least one embodiment, faraday cage backing 335 may be utilized in conjunction with faraday cage cap 311 to provide conductivity for the purpose of shielding the CO sensor 286 from external electrical fields.

Figure 3C:
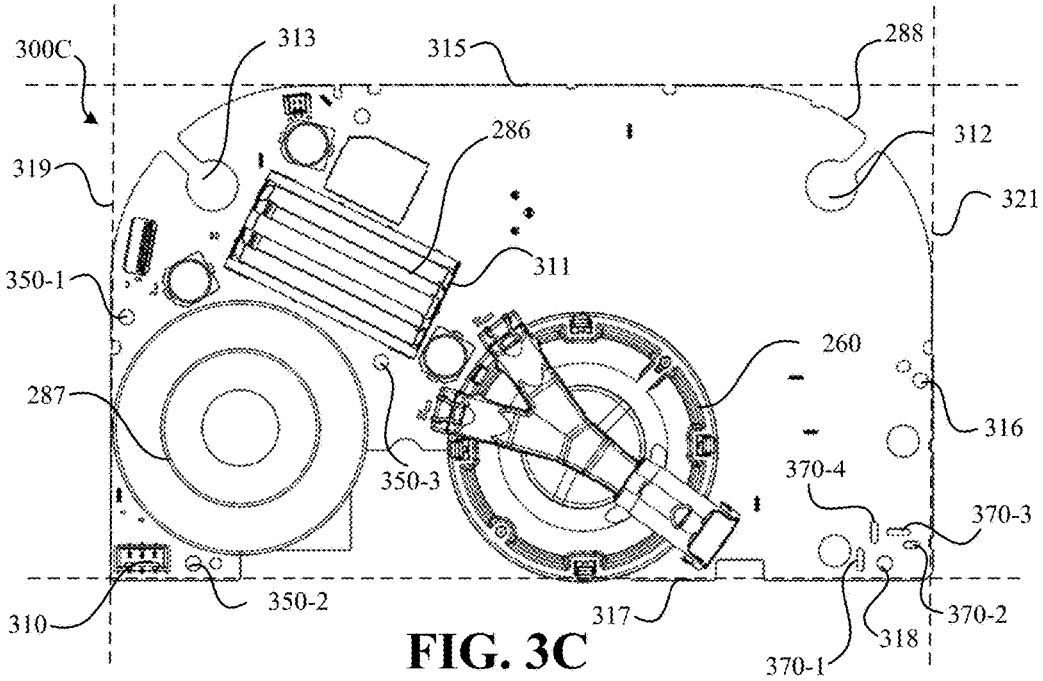
FIG. 3C illustrates a top view of an embodiment of a configuration of various components mounted to the printed circuit board.

FIG. 3C illustrates an top view of an embodiment of a configuration of various components on a printed circuit board (e.g., main circuit board 288) of a smart combined smoke detector and carbon monoxide device. Device 300C may represent an alternate view of the main circuit board 288 of FIGS. 2C and 2D, and devices 300A and 300B. It should be understood that alternate embodiments of device 300C may include a greater number of components or fewer components than presented in FIGS. 3A and 3B. Device 300C may include: main circuit board 288, CO sensor 286, faraday cage cap 311, smoke chamber 260 (with or without chamber shield 289 of FIG. 2), buzzer 287, custom connector 310, attachment interfaces 350-1, 350-2, 350-3, 316, 318, and cutouts 312, 313, 370-1, 370-2, 370-3, and 370-4. It should be understood that alternate embodiments of device 300C may include a greater number of components or fewer components than presented in FIGS. 3A and 3B.

Attachment interfaces 350-1, 350-2, 350-3 (collectively referred to herein as attachment interfaces 350) may each serve as a point at which an attachment mechanism (e.g., a screw or a nail, or the like) may be used to attach another device or component to the circuit board. One or more of the attachment interfaces 350 may additionally, or alternatively, be used to attach main circuit board to other portions of the hazard detector devices (e.g., enclosure 130). One or more of the attachment mechanisms may additionally, or alternatively, be used to attach other portions of the hazard detector device (e.g., main chassis 210) to main circuit board 288.

In accordance with at least one embodiment, utilizing one or more of the attachment interfaces 350 may provide reinforcement to an area of the main circuit board 288 (e.g., an area around and/or covered by the buzzer 287). Such reinforcement may result improved buzzer operations. For example, a reinforcement platform may prevent vibration transfer between the buzzer 287 and the main circuit board 288 enabling the buzzer 287 to maintain a decibel range without losing effectiveness due to vibration transfer. In at least one example, attachment interfaces 350 may be arranged at an equal distance from one another around the circumference of buzzer 287.

For the following non-limiting examples, top guide 315 is intended to indicate a top-most edge of main circuit board 288. Similarly, bottom guide 317, left guide 319, and right guide 321 are intended to indicate a bottom-most edge, left-most edge, and right-most edge of main circuit board 288, respectively.

In accordance with at least one embodiment, main circuit board 288 may measure 129.23 mm from left guide 319 to right guide 321 and 78.06 mm from bottom guide 317 to top guide 315. In a non-limiting example, smoke chamber 260 may be approximately 41.2 mm in diameter. A center of smoke chamber 260 may be located at approximately 73.9-74.5 (e.g., 74.04 mm) from left guide 319 and 20.99 mm from bottom guide 317. It should be understood that measurements included herein are in millimeters unless otherwise specified. Measurements specified are intended as examples only.

In accordance with at least one embodiment, cutout 312 and cutout 313 may be 7.87-8.17 mm (e.g., 8.02 mm) in diameter. The center of the circular portion of cutout 312 may be located 15.77-16.07 mm (e.g., 15.92 mm) from top guide 315 and 15.96 mm from right guide 321. A channel portion of the cutout 312 may radiate from the circular portion of cutout 312 towards a curved corner of main circuit board 288. The channel portion of the cutout 312 may be 2.4-2.7 mm (e.g., 2.55 mm) wide. The center of the circular portion of cutout 313 may be located 15.77-16.07 (e.g., 15.92 mm) from top guide 315 and 15.77-16.07 mm (e.g., 15.92 mm) from right guide 321. A channel portion of the cutout 313 may radiate from the circular portion of cutout 313 towards a curved corner of main circuit board 288. The channel portion of the cutout 313 may be 2.4-2.7 mm (e.g., 2.55 mm) wide.

In accordance with at least one embodiment, a center of attachment interface 316 may, for example, be located 31.18-31.78 mm (e.g., 31.48 mm) from bottom guide 317 and 1.68-2.28 mm (e.g., 1.98 mm) from right guide 321. A center of attachment interface 318 may be located 2.36-2.96 mm (e.g., 2.66 mm) from bottom guide 317 and 7.31-7.91 mm (e.g., 7.61 mm) from right guide 321. A center of attachment interface 350-1 may be located 2.16-2.76 mm (e.g., 2.46 mm) from bottom guide 317 and 41.16-41.76 mm (e.g., 41.46 mm) from left guide 319. A center of attachment interface 350-2 may be located 2.36-2.96 mm (e.g., 2.66 mm) from bottom guide 317 and 12.63-13.23 mm (e.g., 12.93 mm) from left guide 319. A center of attachment interface 350-3 may be located 34.06-32.66 mm (e.g., 34.36 mm) from bottom guide 317 and 42.13-42.73 mm (e.g., 42.43 mm) from left guide 319.

In accordance with at least one embodiment, a center of buzzer 287 may be located 23.71-24.31 mm (e.g., 24.01 mm) from bottom guide 317 and 20.01-20.61 mm (e.g., 20.31 mm) from left guide 319. Buzzer 287 may include stacked rings. In some examples, the stacked rings may be concentrically aligned. The top ring may have an diameter of 24.9 mm with respect to the outer edge of the top ring. The stacked rings may form an aperture between the main circuit board 288 and the interior walls of buzzer 287 when buzzer 287 is connected to main circuit board 288. Thus, as connected, the buzzer 287 is at least partially hollow.

In accordance with at least one embodiment, a center of custom connector 310 may be located at 7.72-8.33 mm (e.g., 8.03 mm) from bottom guide 317 and 3.17-3.77 mm (e.g., 3.47 mm) from left guide 319.

In accordance with at least one embodiment, a center of cutout 370-1 may be located at 3.66-4.26 mm (e.g., 3.96 mm) from bottom guide 317 and 11.14-11.74 mm (e.g., 11.44 mm) from right guide 321. Cutout 370-1 may be, in some examples, 1 mm wide and a rectangular area of the cutout (excluding the rounded ends) may be 1.28 mm long. In accordance with at least one embodiment, a center of cutout 370-2 may be located at 5.29-5.89 mm (e.g., 5.59 mm) from bottom guide 317 and 3.84-4.44 mm (e.g., 4.14 mm) from right guide 321. Cutout 370-2 may be, in some examples, 1 mm wide and a rectangular area of the cutout (excluding the rounded ends) may be 1.53 mm long. In accordance with at least one embodiment, a center of cutout 370-3 may be located at 7.29-7.89 mm (e.g., 7.59 mm) from bottom guide 317 and 5.14-5.74 mm (e.g., 5.44 mm) from right guide 321. Cutout 370-3 may be, in some examples, 1 mm wide and a rectangular area of the cutout (excluding the rounded ends) may be 2.6 mm long. In accordance with at least one embodiment, a center of cutout 370-4 may be located at 7.29-7.89 mm (e.g., 7.59 mm) from bottom guide 317 and 8.94-9.54 mm (e.g., 9.24 mm) from right guide 321. Cutout 370-4 may be, in some examples, 1 mm wide and a rectangular area of the cutout (excluding the rounded ends) may be 2.6 mm long.

Figure 3D:
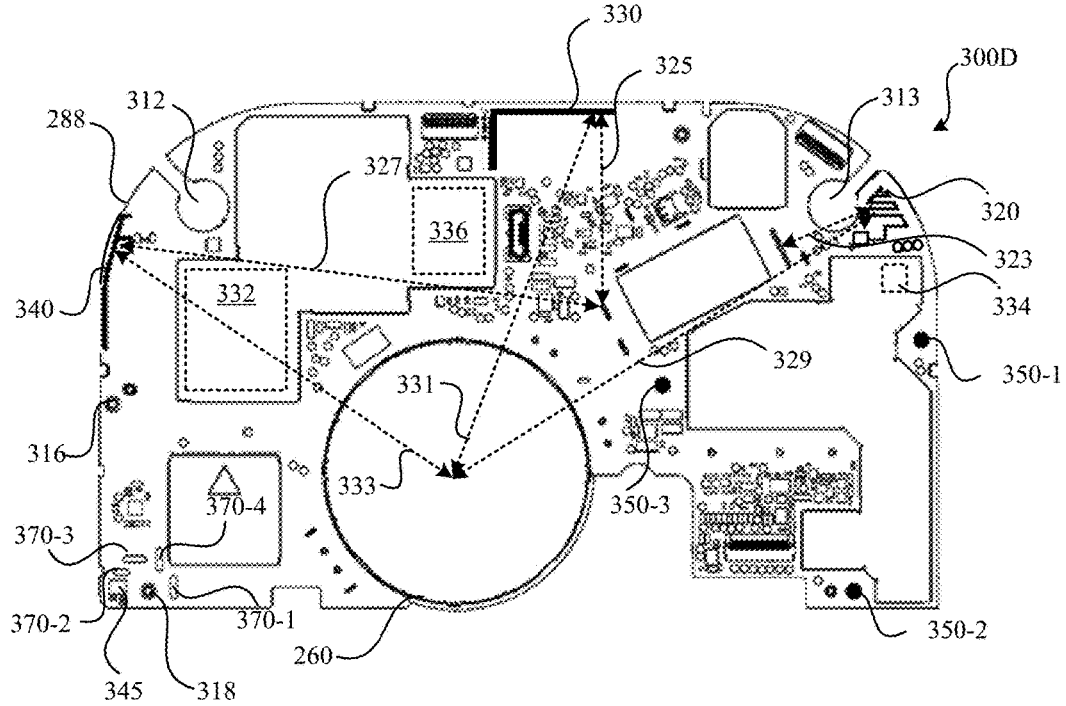
FIG. 3D illustrates a bottom view of an embodiment of a configuration of various components mounted to the printed circuit board.

FIG. 3D illustrates an bottom view of an embodiment of a configuration of various components on a printed circuit board of a smart combined smoke detector and carbon monoxide device. Device 300D may represent an alternate view of the main circuit board 288 of FIGS. 2C and 2D, and devices 300A, 300B, and 300C. It should be understood that alternate embodiments of device 300D may include a greater number of components or fewer components than presented in FIGS. 3A-3C. Device 300D may include: main circuit board 288, attachment interfaces 316, 318, 350-1, 350-2, 350-3, cutouts 312, 313, 370-1, 370-2, 370-3, and 370-4, wireless interface component (antenna) 320, radio chip 324, wireless interface component (antenna) 330, radio chip 336, faraday cage backing 335, wireless interface component (antenna) 340, radio chip 332 and RHT sensor 345. It should be understood that alternate embodiments of device 300D may include a greater number of components or fewer components than presented in FIGS. 3A-3C.

In accordance with at least one embodiment, a distance between a lead of CO sensor 286 and wireless interface component 320 (which may be a Bluetooth® low-energy (BLE) antenna), indicated by distance measurement 323, may be in a range of 12-14 mm (e.g., 13.19 mm). Wireless interface component 320 may be communicatively coupled to radio chip 334. Radio chip 334 may serve to function as a transceiver for sending and receiving communications in accordance with the Bluetooth® Low-Energy (BLE) standard via wireless interface component 320. In other embodiments, another communication protocol may be used by radio chip 334. Radio chip 334 may be located below a cover or RF shielding, such as illustrated in FIG. 3D. In accordance with at least one embodiment, a distance between a lead of CO sensor 286 and wireless interface component 330 (which may be a WiFi® antenna, or otherwise used for communicating with a network using the IEEE 802.11 standard), indicated by distance measurement 325, may be within a distance of 31 mm (e.g., 29.44 mm). Wireless interface component 330 may be communicatively coupled to radio chip 336. Radio chip 336 may serve to function as a transceiver for sending and receiving communications in accordance with the IEEE 802.11 standard (e.g., WiFi®) via wireless interface component 330. In other embodiments, another communication protocol may be used by radio chip 336. Radio chip 336 may be located below a cover or RF shielding, such as illustrated in FIG. 3D. A distance between a lead of CO sensor 286 and wireless interface component 340 (which may be an antenna used for communicating in accordance with the IEEE 802.15.4 standard), indicated by distance measurement 327, may be in a range of 70-74 mm (e.g., 72.26 mm). Wireless interface component 340 may be communicatively coupled to radio chip 332. Radio chip 332 may serve to function as a transceiver for sending and receiving communications in accordance with the IEEE 802.15.4 standard via wireless interface component 340. In other embodiments, another communication protocol may be used by radio chip 332. Radio chip 332 may be located below a cover or RF shielding, such as illustrated in FIG. 3D. The noted covers/RF shield may serve to protect components for incidental user contact, block RF which can cause interference among components, and/or can help laminar air flow within the device.

In accordance with at least one embodiment, a distance between a center of smoke detector 260 and wireless interface component 320, indicated by distance measurement 329, may measure 78.44-79.04 mm (e.g., 78.74 mm). In accordance with at least one embodiment, a distance between a center of smoke detector 260 and wireless interface component 330, indicated by distance measurement 331, may measure 56.18-56.78 mm (e.g., 56.48 mm). A distance between a center of smoke detector 260 and wireless interface component 340, indicated by distance measurement 333, may measure 62.58-63.18 mm (e.g., 62.88 mm).

Figure 3E:
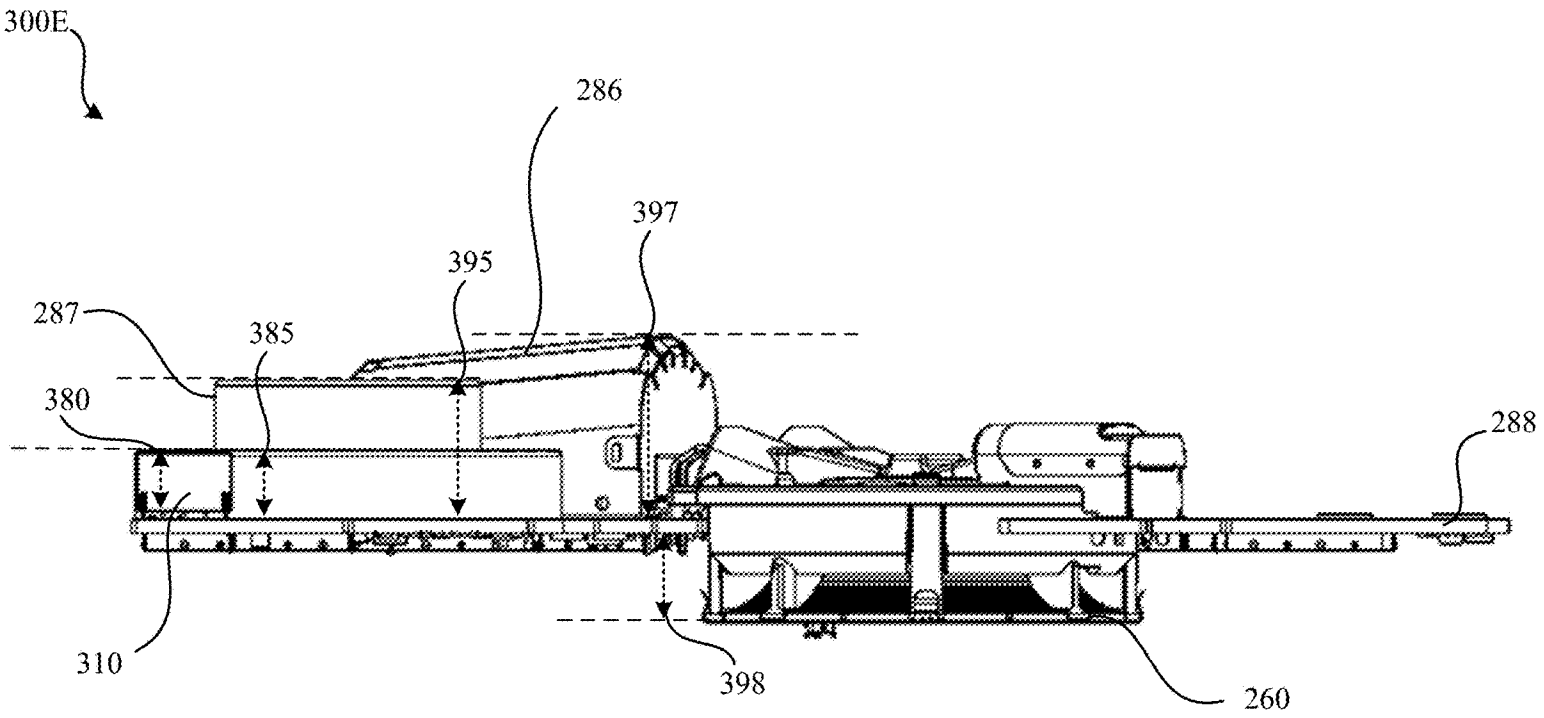
FIG. 3E illustrates a side view of an embodiment of a configuration of various components mounted to the printed circuit board.

FIG. 3E illustrates an side view of an embodiment of a configuration of various components on a printed circuit board of a smart combined smoke detector and carbon monoxide device. Device 300E may represent an alternate view of the main circuit board 288 of FIGS. 2C and 2D, and devices 300A, 300B, 300C, and 300D. It should be understood that alternate embodiments of device 300E may include a greater number of components or fewer components than presented in FIGS. 3A-3D. Device 300E may include: main circuit board 288, CO sensor 286, smoke chamber 260, buzzer 287, and custom connector 310.

In accordance with at least one embodiment, custom connector 310 may have a maximum height of 6.2 mm as indicated by distance 380. The bottom ring of buzzer 287 may have a maximum height of 6.5 mm as indicated by distance 385. The top ring of buzzer 287 may have a maximum height of 13 mm and indicated by distance 395. A proximate end of CO sensor 286 may have a height ranging from 15.98-16.88 mm (e.g., 16.48 mm) as indicated by distance 397. In accordance with at least one embodiment, a distance by which a smoke chamber 260 may extend past a plane of the main circuit board 288 may not exceed 2 mm as depicted by distance 398 of FIG. 3E.

Figure 4A:
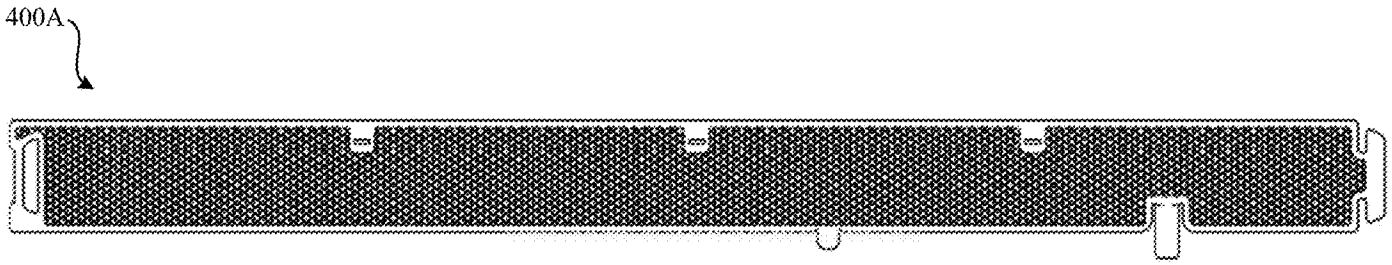
FIGS. 4A-4C illustrate an embodiment of a mesh that can be wrapped around an embodiment of the smoke chamber to provide metallic shielding from electronic interference.
Figure 4B:
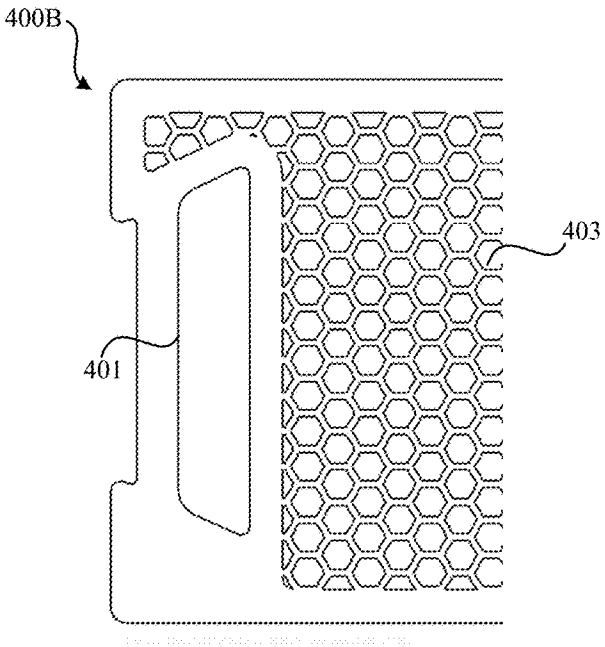
Figure 4C:
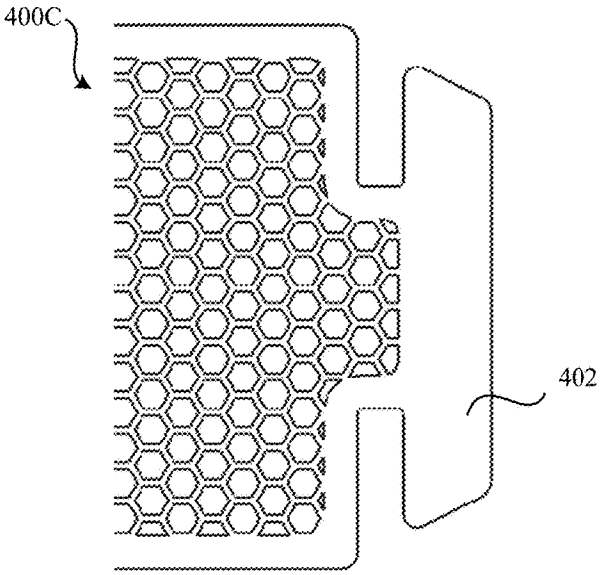

FIGS. 4A-4C illustrate an embodiment of a mesh that can be wrapped around an embodiment of a smoke chamber to provide metallic shielding from electronic interference. FIG. 4A illustrates an embodiment of a mesh 400A that can be wrapped around the various detailed embodiments of smoke chambers to prevent large particulate matter (e.g., bugs, dust) from entering the smoke chamber. Such large particulate matter, if in the smoke chamber, may result in a false detection of smoke, leading to an alarm being sounded when no smoke or fire is present. Mesh 400A may be wrapped around smoke chambers 260 of FIG. 3A-3D such that airflow path around the smoke chamber is fully encircled by mesh 400A. As such, all airflow entering (and exiting) the smoke chambers 260 passes through mesh 400A.

Mesh 400A may be conductive. More specifically mesh 400A may be metallic. Mesh 400A is further represented by first mesh end 400B of FIG. 4B and second mesh end 400C of FIG. 4C. First mesh end 400B (which represents the left end of mesh 400A) includes tab joint 401 which is configured to receive tab 402 of second mesh end 400C (which represents the right end of mesh 400A) when mesh 400A is wrapped around a smoke chamber. While tab 402 and tab joint 401 represent one possible embodiment of how the ends of mesh 400A can be joined together, it should be understood that other attachment methods and/or mechanisms can be used (e.g., glue, clips, etc.). Present on mesh 400A and visible on first mesh end 400B and second mesh end 400C is a hexagonal mesh pattern 403 that allows substantial airflow through mesh 400A.

Mesh 400A may function in concert with chamber shield 289 of FIGS. 2C and 2D, which can serve as a conductive (e.g., metallic) cover over the smoke chamber. A conductive base, which may be a field of solder present on an underlying circuit board or a conductive barrier similar to chamber shield 289, may be present on the opposite side of a smoke chamber such that the smoke chamber is surrounded by a conductive barrier. This conductive barrier, which serves as a Faraday cage, can serve to decrease an amount of electromagnetic noise (generated by external sources) sensed by the electromagnetic sensor (e.g., a photoelectric diode) present within the smoke chamber. Mesh 400A may be manufactured as a single piece of metal that includes a chamber shield 289. A tab may be bent such to allow chamber shield 289 to be placed atop a smoke chamber.

In some embodiments, mesh 400A is connected with chamber shield 289 by the two components being formed from a single piece of metal and connected via tab 405. Chamber shield 289 may be folded over the top of a smoke chamber while the remainder of the mesh 400A is wrapped around the smoke chamber. In some embodiments, on the opposite side of the smoke chamber from chamber shield 289, the smoke chamber may not be fully encased in a conductive shield. Rather, only a portion of the smoke chamber proximate to the location of the electromagnetic sensor may be wrapped in a conductive material. Such an arrangement may decrease the total amount of conductive material that needs to be used to effectively provide a Faraday cage around the electromagnetic sensor.

Figure 5A:
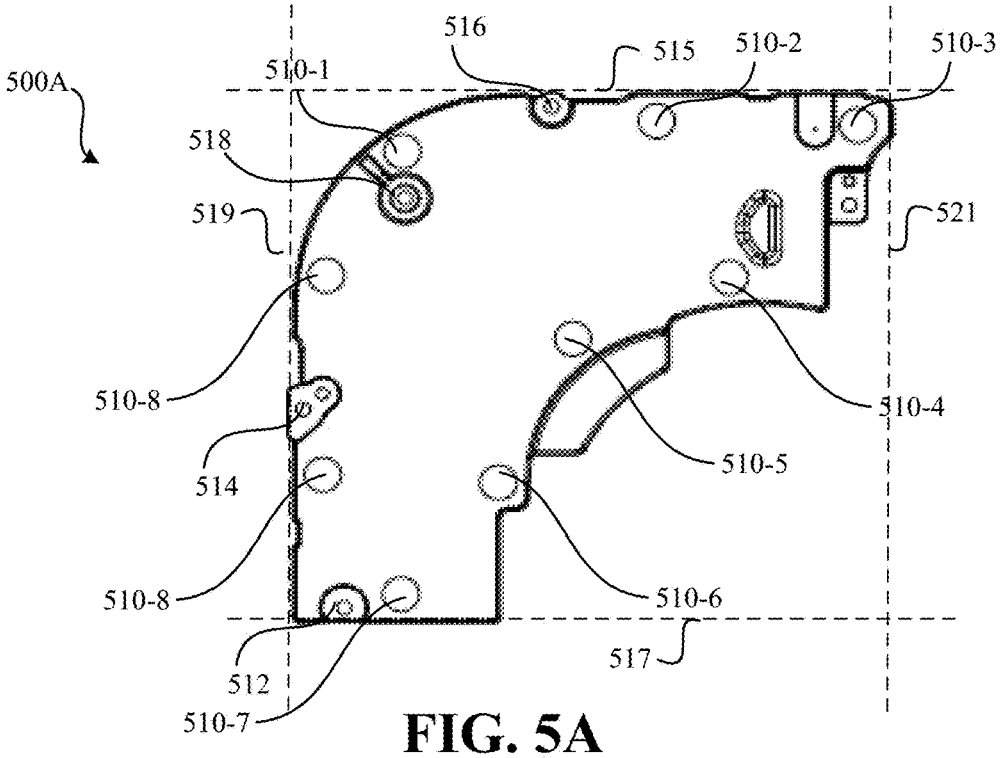
FIG. 5A illustrates a bottom view of an embodiment of a speaker.

FIG. 5A illustrates a bottom view of an embodiment of a speaker. Device 500A may represent an alternate view of speaker 220 of FIGS. 2C and 2D. It should be understood that alternate embodiments of device 500A may include a greater number of components or fewer components than presented in FIG. 5A. Device 500A may include: pads 510-1, 510-2, 510-3, 510-4, 510-5, 510-5, 510-6, 510-7, 510-8 (collectively referred to herein as pads 510), attachment interface 512, attachment interface 514, attachment interface 516, and protrusion 518.

In accordance with at least one embodiment, device 500A (e.g., speaker 220) may include an L-shaped speaker box. An area at which the base of the speaker box meets the side of the speaker box may include a degree of curvature. It should be understood that the speaker may be shaped differently than depicted in FIG. 5. Pads 510 may include foam or any suitable material for preventing vibration transfer between speaker 220 and main circuit board 288. Pads 510 may be arranged as depicted in FIG. 5A or pads 510 may be otherwise arranged on speaker 220. More or fewer pads may be included in order to prevent damage to speaker 220 while in operation. Individual pads may be approximately 0.4 mm in thickness.

In accordance with at least one embodiment, speaker 220 may include attachment interface 512. A center of attachment interface 512 may be located on speaker 220 1.97-2.56 mm (e.g., 2.27 mm) from bottom guide 517 and 6.84-7.44 mm (e.g., 7.14 mm) from the left guide 519. A center of attachment interface 514 may be located on speaker 220 30.79-31.39 mm (e.g., 31.09 mm) from bottom guide 517 and 1.22-1.82 mm (e.g., 1.52 mm) from left guide 519. A center of attachment interface 516 may be located on speaker 220 1.83-2.42 mm (e.g., 2.13 mm) from top guide 515 and 35.27-35.87 mm (e.g., 35.57 mm) from left guide 519.

In accordance with at least one embodiment, speaker 220 may include protrusion 518. Protrusion 518 may be functional to connect speaker 220 to main circuit board 288 via cutout 312, for example.

Figure 5B:
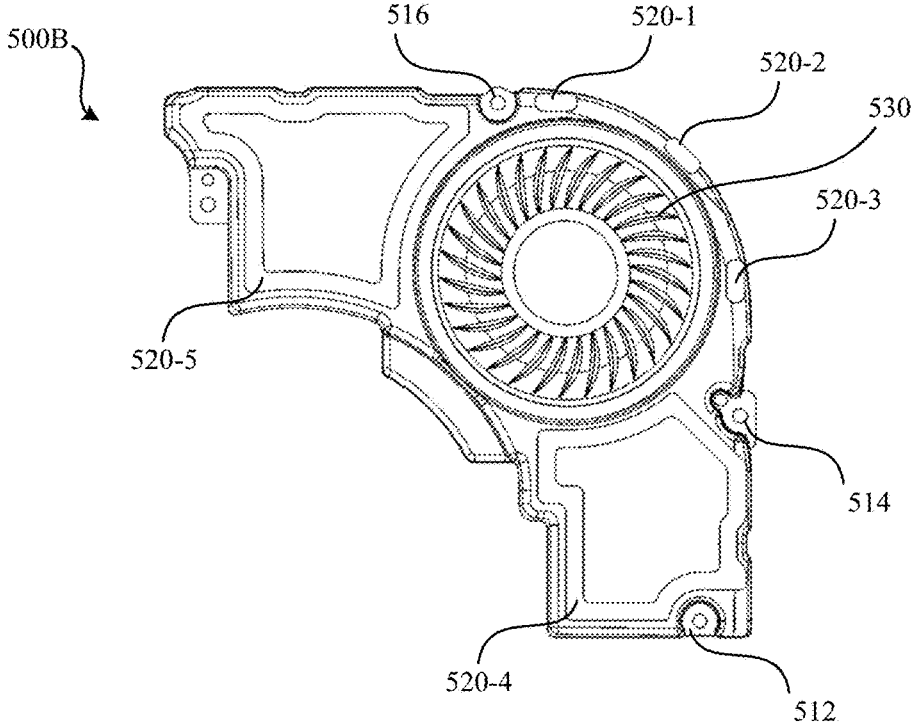
FIG. 5B illustrates a top view of an embodiment of a speaker.

FIG. 5B illustrates a top view of an embodiment of a speaker. Device 500B may represent an alternate view of speaker 220 of FIGS. 2C, 2D, and 5A. It should be understood that alternate embodiments of device 500B may include a greater number of components or fewer components than presented in FIG. 5A. Device 500B may include: pads 520-1, 520-2, 520-3, 520-4, 520-5 (collectively referred to herein as pads 520), attachment interface 512, attachment interface 514, attachment interface 516, dust cover 530, and protrusion 540.

In accordance with at least one embodiment, pads 520 may include foam or any suitable material for preventing vibration transfer between speaker 220 and main circuit board 288. Pads 520 may be arranged in the manner depicted in FIG. 5A or pads 510 may be otherwise arranged on speaker 220. More or fewer pads may be included in order to prevent damage to speaker 220 while in operation. Individual pads may be approximately 0.4 mm in thickness.

In accordance with at least one embodiment, speaker 220 may include dust cover 530. Dust cover 530 may fit on top of or over a voice coil former of speaker 220. Dust cover 530 may attach to a cone of speaker 220. In at least one example, dust cover 530 may protect the interior workings of the speaker 220. Dust cover may be made of paper, felt, screen, aluminum, rubber, polypropylene, or any suitable material.

Figure 5C:
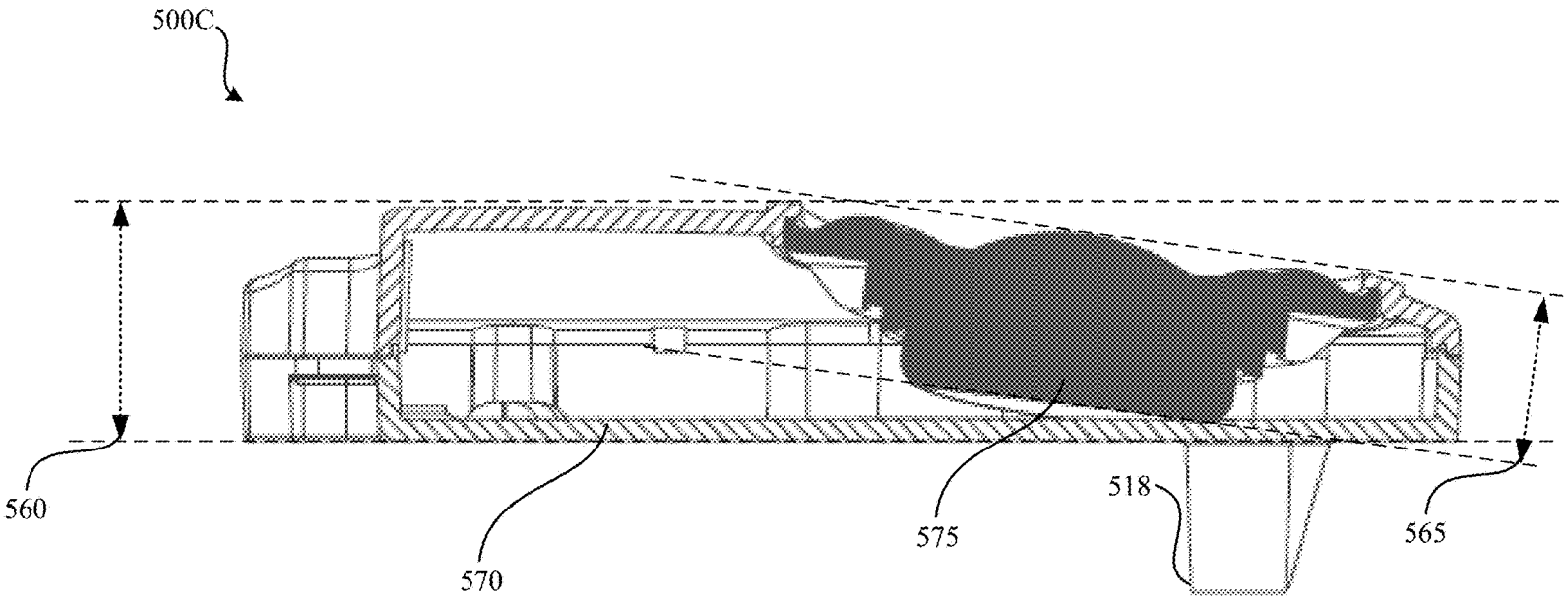
FIG. 5C illustrates an embodiment of a cross section of the speaker.

FIG. 5C illustrates an embodiment of a cross section of the speaker of FIGS. 5A and 5B. Device 500C may represent an alternate view of speaker 220 of FIGS. 2C, 2D, 5A, and 5B. It should be understood that alternate embodiments of device 500C may include a greater number of components or fewer components than presented in FIG. 5A or 5B. Device 500C may include: speaker box 570 and cone 575. Speaker 220 may be substantially hollow excluding the space containing cone 575. In at least one example, speaker box 570 may be 15.9 mm high as depicted by distance 560. In accordance with at least one embodiment, cone 575 may be 11.61 mm high as depicted by distance 565.

Figure 5D:
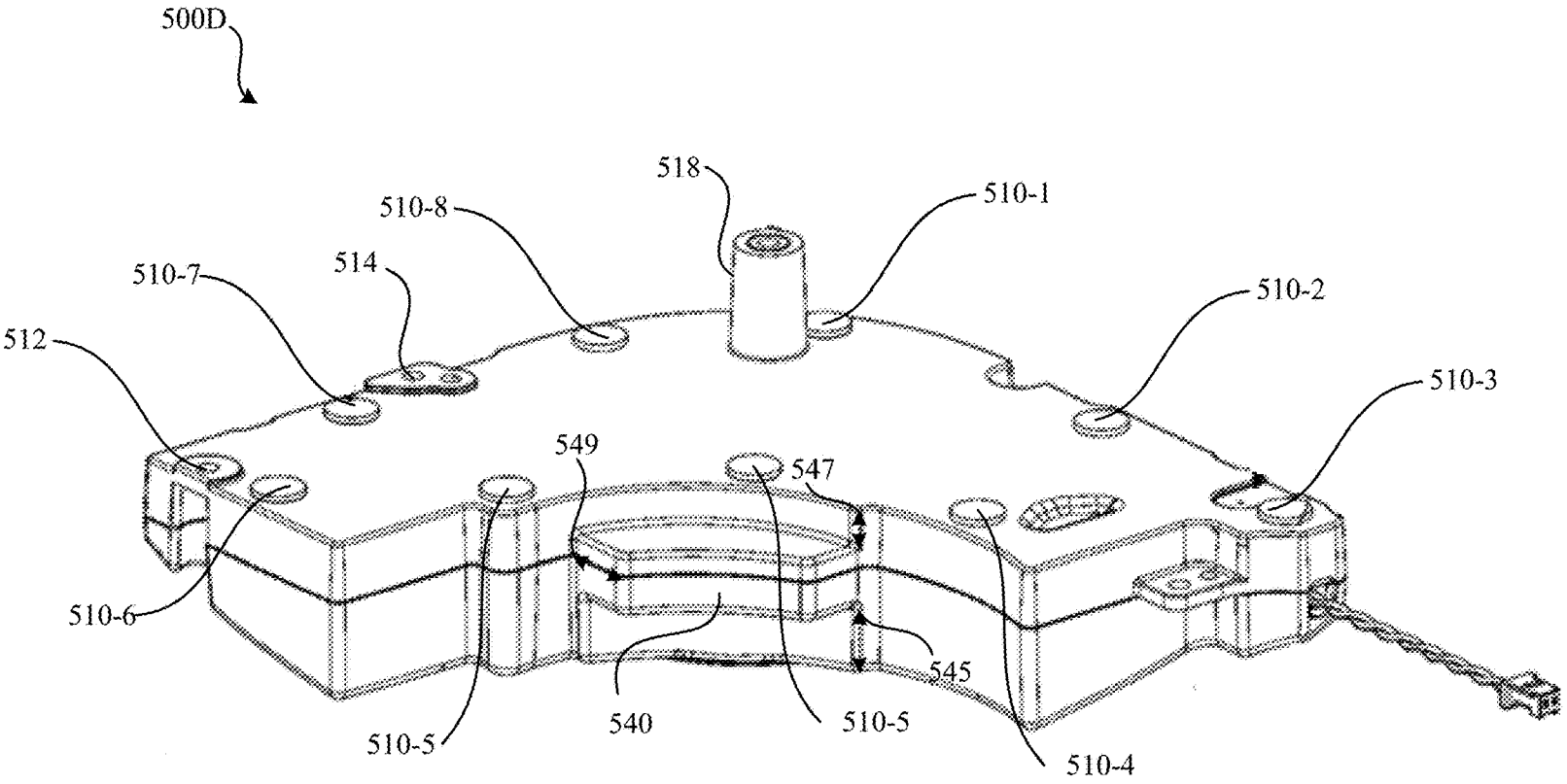
FIG. 5D illustrates an bottom angled view of an embodiment of the speaker.

FIG. 5D illustrates an bottom angled view of an embodiment of a speaker. Device 500D may represent an alternate view of speaker 220 of FIGS. 2C, 2D, and 5A-5C. It should be understood that alternate embodiments of device 500D may include a greater number of components or fewer components than presented in FIGS. 5A-5C. Device 500D may include: pads 510, attachment interface 512, attachment interface 514, attachment interface 516, protrusion 518, and protrusion 540. Protrusion 540 may extend from a wall of the speaker 220 approximately 6.12 mm as depicted by distance 549. A plane of a first face of the protrusion 540 and a plane of the top of the speaker 220 may be spaced 6.73 mm apart as depicted by distance 545. A plane of a second face of the protrusion 540 and a plane of the bottom of speaker 220 may be spaced 3.69 mm apart as depicted by distance 547. In accordance with at least one embodiment, protrusion 540 may extend over a portion of smoke chamber 260 when speaker 220 is connected to main circuit board 260.

Figure 6:
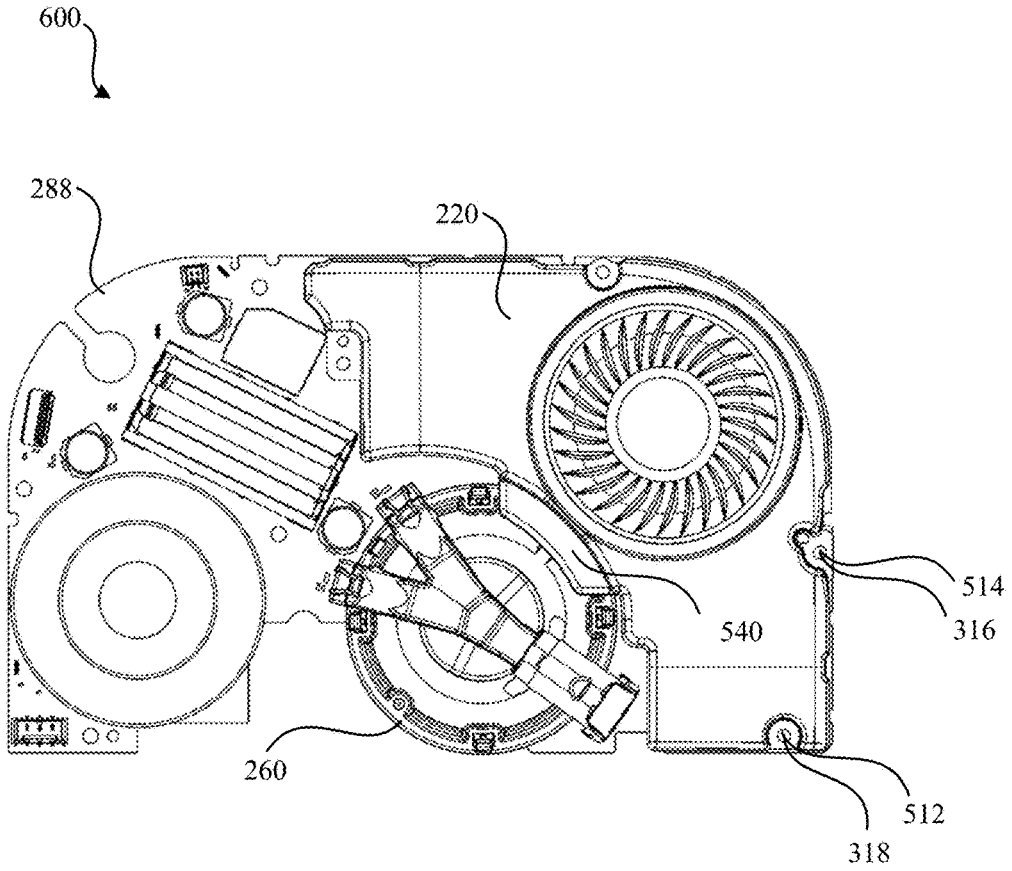
FIG. 6 illustrates a top view of an embodiment of a configuration of the speaker mounted to the printed circuit board.

FIG. 6 illustrates a top view of an embodiment of a configuration of a speaker (e.g., the speaker of FIGS. 2C, 2D, and 5A-5D) mounted on the printed circuit board (e.g., main circuit board 288 of FIGS. 2C, 2D, and 3A-3E). It should be understood that speaker 220 may be mounted to main circuit board 288 in other configurations other than the one depicted in FIG. 6. As a non-limiting example, speaker 220 may be connected to main circuit board 288 by inserting protrusion 518 of FIGS. 5A, 5C, and 5D (not visible in FIG. 6) into cutout 312 of FIGS. 3A, 3C, and 3C (not pictured in FIG. 6. Following insertion, speaker 220 may be manipulated toward main circuit board 288 until the surface of main circuit board 288 contacts a surface of the speaker 220. At such point, attachment interface 514 of FIGS. 5A, 5B, and 5D may concentrically align with attachment interface 316 of FIGS. 3A-3D (not visible in FIG. 6). Additionally, upon contact, attachment interface 512 of FIGS. 5A, 5B, and 5D may concentrically align with attachment interface 318 of FIGS. 3A-3D (not visible in FIG. 6). In accordance with at least one embodiment, upon contact of speaker 220 and main circuit board 288, protrusion 540 may extend over a portion of smoke chamber 260.

Figure 7A:
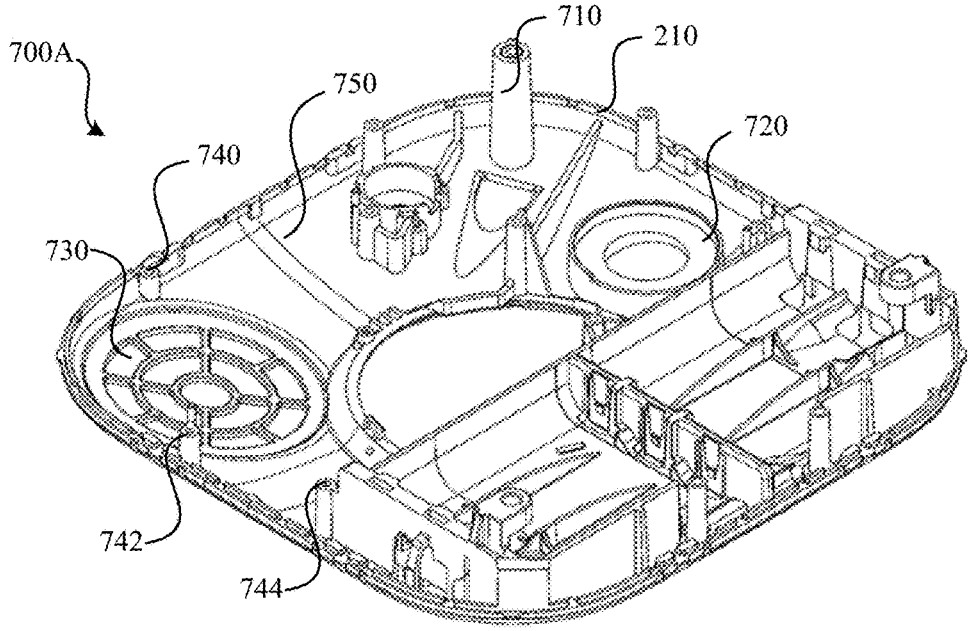
FIG. 7A illustrates an angular projection of an embodiment of a chassis.

FIG. 7A illustrates an angular projection of an embodiment of a chassis (e.g., main chassis 210 of FIGS. 2C and 2D. Device 700A may represent an alternate view of main chassis 210 of FIGS. 2C, and 2D. It should be understood that alternate embodiments of device 700A may include a greater number of components or fewer components than presented in FIG. 2C or 2D. Device 700A may include: attachment recess 740, attachment recess 742, attachment recess 744, speaker cover reinforcement 730, protrusion 710, and buzzer interface 720.

In accordance with at least one embodiment, main chassis 210 includes a front surface 750 having a domed contour. In at least one example, the domed contour of main chassis 210 may include an inner portion that defines a chassis central aperture. Such a chassis central aperture may have a maximum height limit in accordance with the domed contour. For example, components being housed by main chassis 210 may be taller (e.g., under a first threshold height) if the component is located with a threshold distance of the center of the main chassis 210. Accordingly, components is located closer to an edge of the main chassis 210 (e.g., within a second threshold distance) may be required to be shorter (e.g., under a second threshold height) in order to be under maximum height limit for the chassis central aperture. As the distance from the center of the chassis is increased, the threshold height may gradually decrease due to the domed shape of the chassis.

In accordance with at least one embodiment, speaker cover reinforcement 730 may include a material that has greater rigidity than dust cover 530 of FIG. 5B. Buzzer interface 720 may include a ring having a planar surface, the ring being encircled by a lipped edge.

Figure 7B:
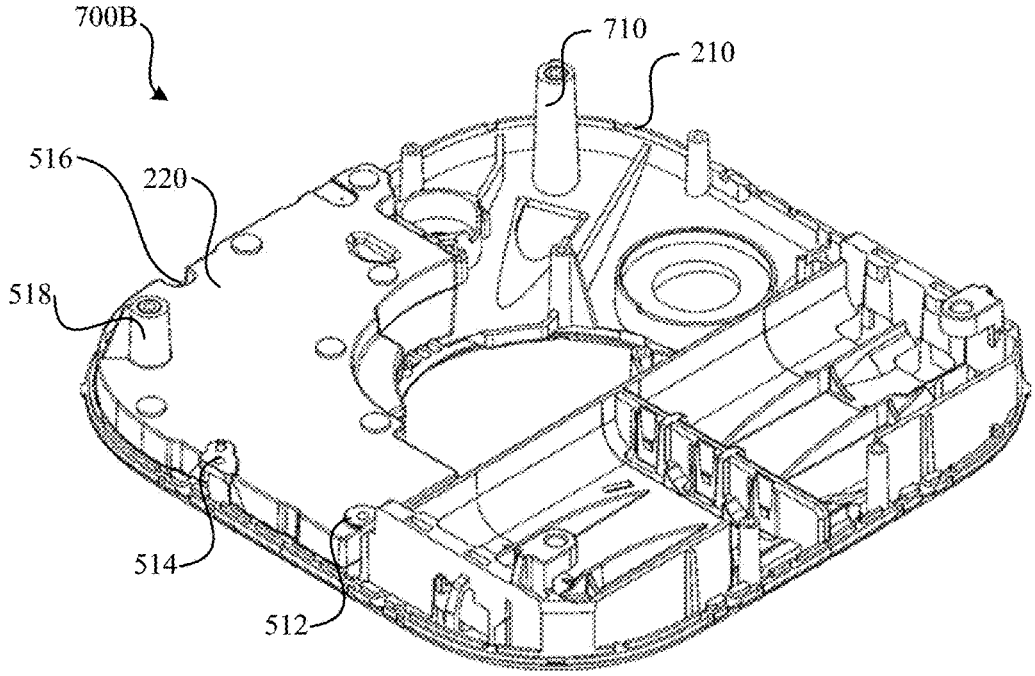
FIG. 7B illustrates an angular projection of an embodiment of a configuration of a speaker connected to the chassis.

FIG. 7B illustrates an angular projection of an embodiment of a configuration of a speaker as connected to the chassis of FIG. 7A. Device 700B may represent an alternate view of main chassis 210 of FIGS. 2C, and 2D connected to speaker 220 of FIGS. 2C, 2D, and 5A-5D. It should be understood that alternate embodiments of device 700B may include a greater number of components or fewer components than presented in FIGS. 2C, 2D, 5A-5D, and 7A. As depicted in FIG. 7B, speaker 220 may be attached to main chassis 210 such that a speaker cover reinforcement 730 may extend over dust cover 530 (not visible in FIG. 7B). Upon contact between speaker 220 and main chassis 210, attachment interface 516 of FIGS. 5A, 5B, and 5D may concentrically align with attachment recess 740 (not visible in FIG. 7B). In at least one example, attachment interface 514 of FIGS. 5A, 5B, and 5D may concentrically align with attachment recess 742 (not visible in FIG. 7) and attachment interface 512 of FIGS. 5A, 5B, and 5D may concentrically align with attachment recess 744 (not visible in FIG. 7B).

Figure 7C:
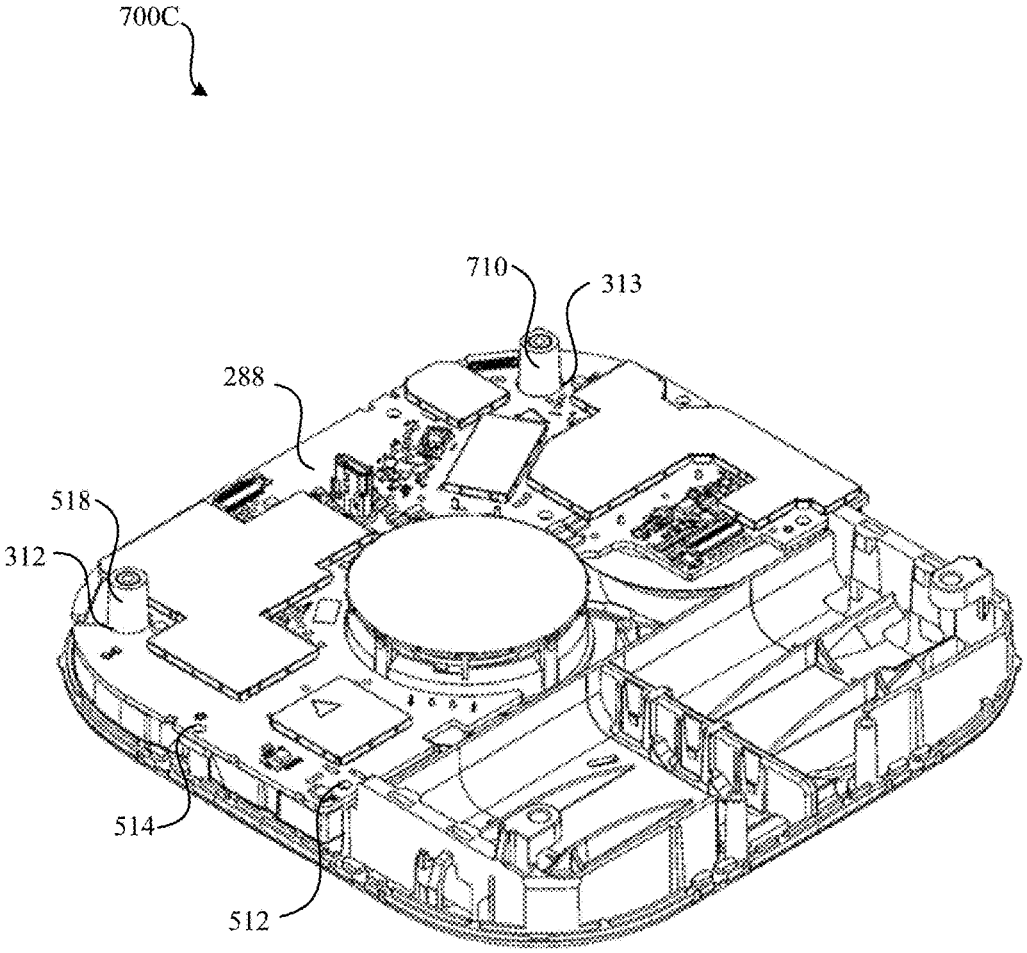
FIG. 7C illustrates an angular projection of an embodiment of a configuration of a printed circuit board connected to the speaker and the chassis.

FIG. 7C illustrates an angular projection of an embodiment of a configuration of a printed circuit board (e.g., main circuit board 288 of FIGS. 2C, 2D, and 3A-3E) as connected to speaker 220 and main chassis 210 of FIGS. 7A and 7B. Device 700C may include a greater number of components or fewer components than presented in FIGS. 2C, 2D, 5A-5D, 7A, and 7B. As depicted in FIG. 7C, main circuit board 288 may be attached to main chassis 210 such that such that main circuit board 288 covers speaker 220 (partially visible in FIG. 7C). As a non-limiting example, main circuit board 288 by inserting protrusion 518 of FIGS. 5A, 5C, and 5D of speaker 220 into cutout 312, while simultaneously inserting protrusion 710 into cutout 313. Following insertion, main circuit board 288 may be manipulated toward main chassis 210 until main circuit board 288 comes to rest on main chassis 210 and speaker 220. Upon contact between main circuit board 288, speaker 220, and main chassis 210, attachment interface 316 of FIGS. 3A-3D (not visible) may concentrically align with attachment interface 514 of FIGS. 5A, 5B, and 5D and attachment recess 740 (not visible). Further, attachment interface 318 of FIGS. 3A-3D (not visible) may concentrically align with attachment interface 512 of FIGS. 5A, 5B, and 5D and attachment recess 744 (not visible).

Figure 7D:
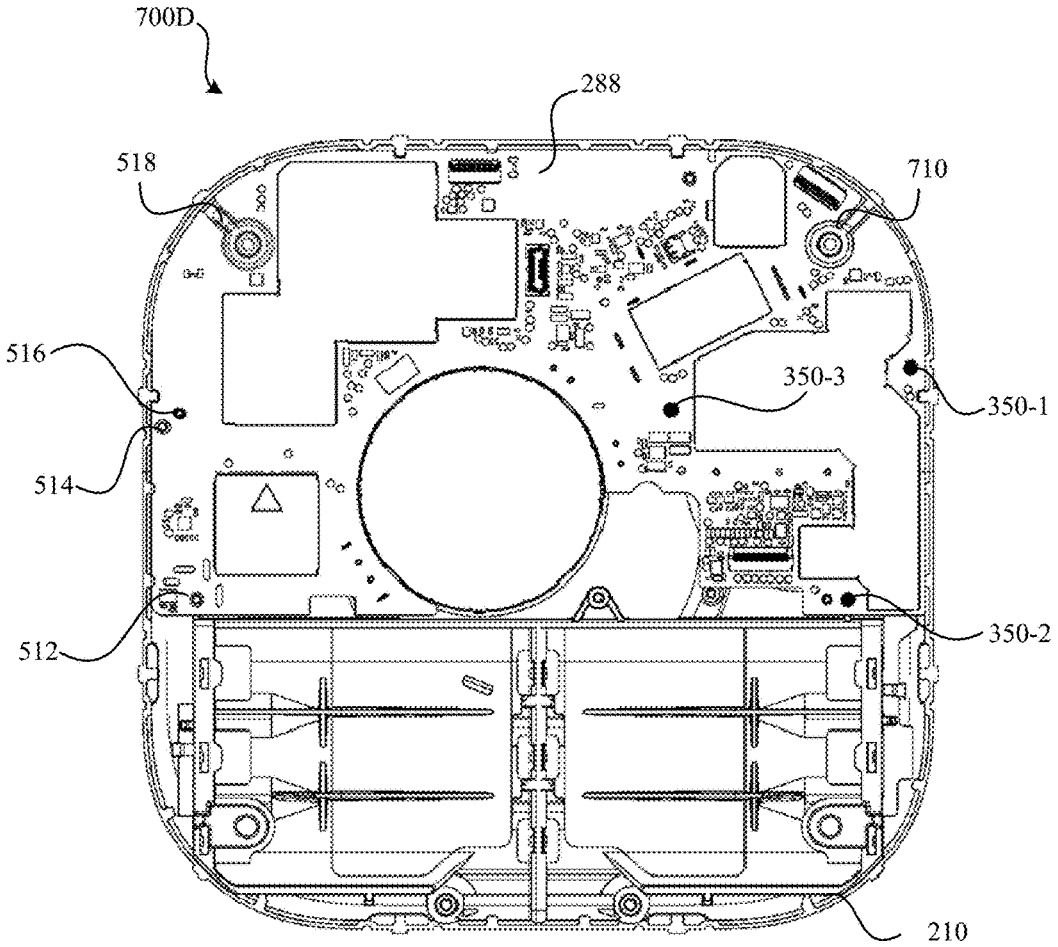
FIG. 7D illustrates a top view of an embodiment of a configuration of a printed circuit board connected to the speaker and the chassis.

FIG. 7D illustrates a top view of an embodiment of a configuration of a printed circuit board as connected to the speaker and chassis of FIGS. 7A-7C. Device 700D may represent an alternate view of main circuit board 288 as connected to speaker 220 and main chassis 210 as depicted in FIG. 7C. It should be understood that alternate embodiments of device 700D may include a greater number of components or fewer components than presented in FIG. 7C. Device 700D may include: main circuit board 288, main chassis 210, protrusion 518, protrusion 710, attachment interfaces 350-1, 350-2, 350-3, 512, 514, and 516. In at least one embodiment, a proximal end of protrusion 518 and a proximal end of protrusion 710 share a plane.

Figure 8:
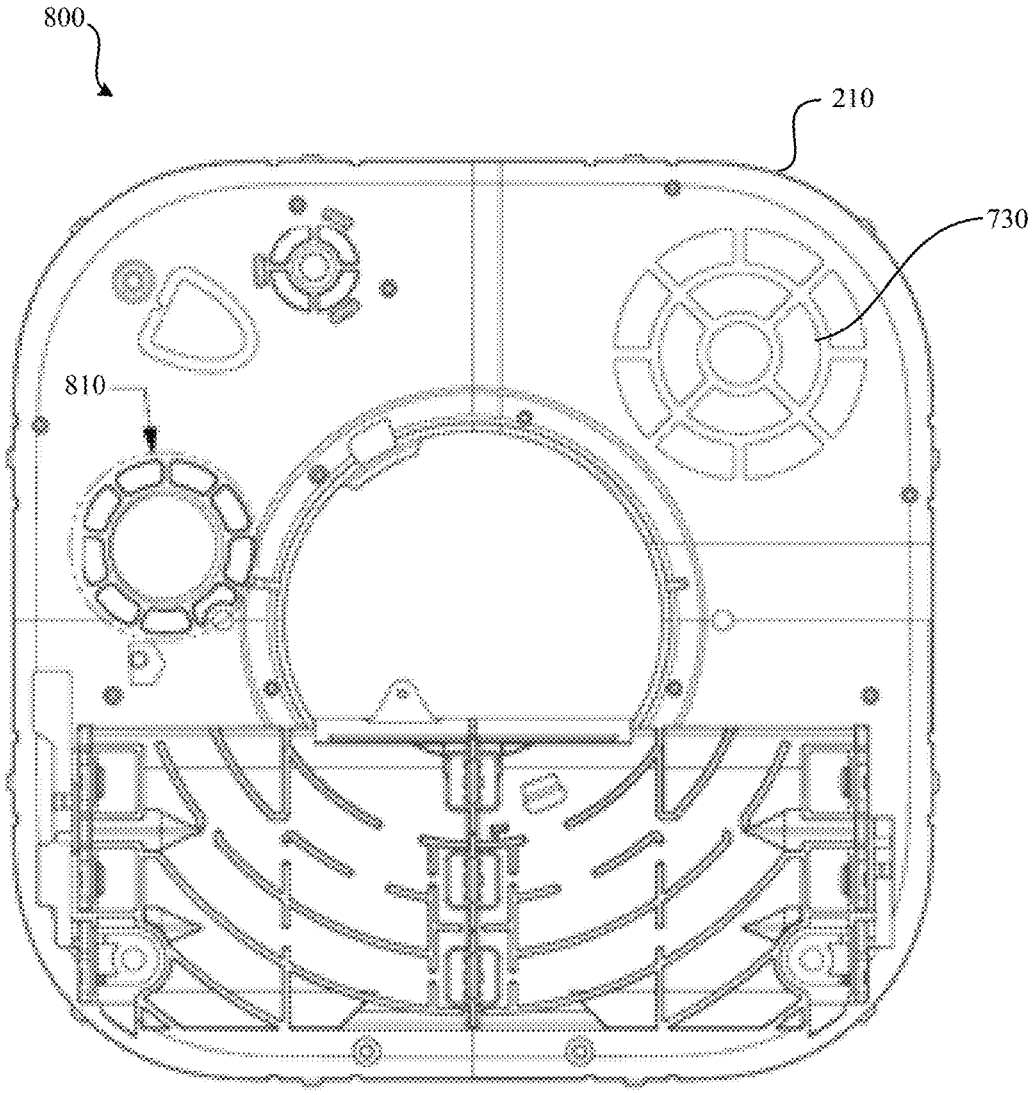
FIG. 8 illustrates an embodiment of a chassis.

FIG. 8 illustrates an embodiment of a chassis (e.g., main chassis of FIGS. 2C, 2D, and 7A-7D). Device 800 may represent an alternate view of main chassis 210. It should be understood that alternate embodiments of device 800 may include a greater number of components or fewer components than presented in FIGS. 2C, 2D, and 7A-7D. Device 800 may include: raised ring 810 and speaker cover reinforcement 730. In at least one embodiment, raised ring 810 may include a proximal end of buzzer interface 720 of FIGS. 7A and 7B.

Figure 9:
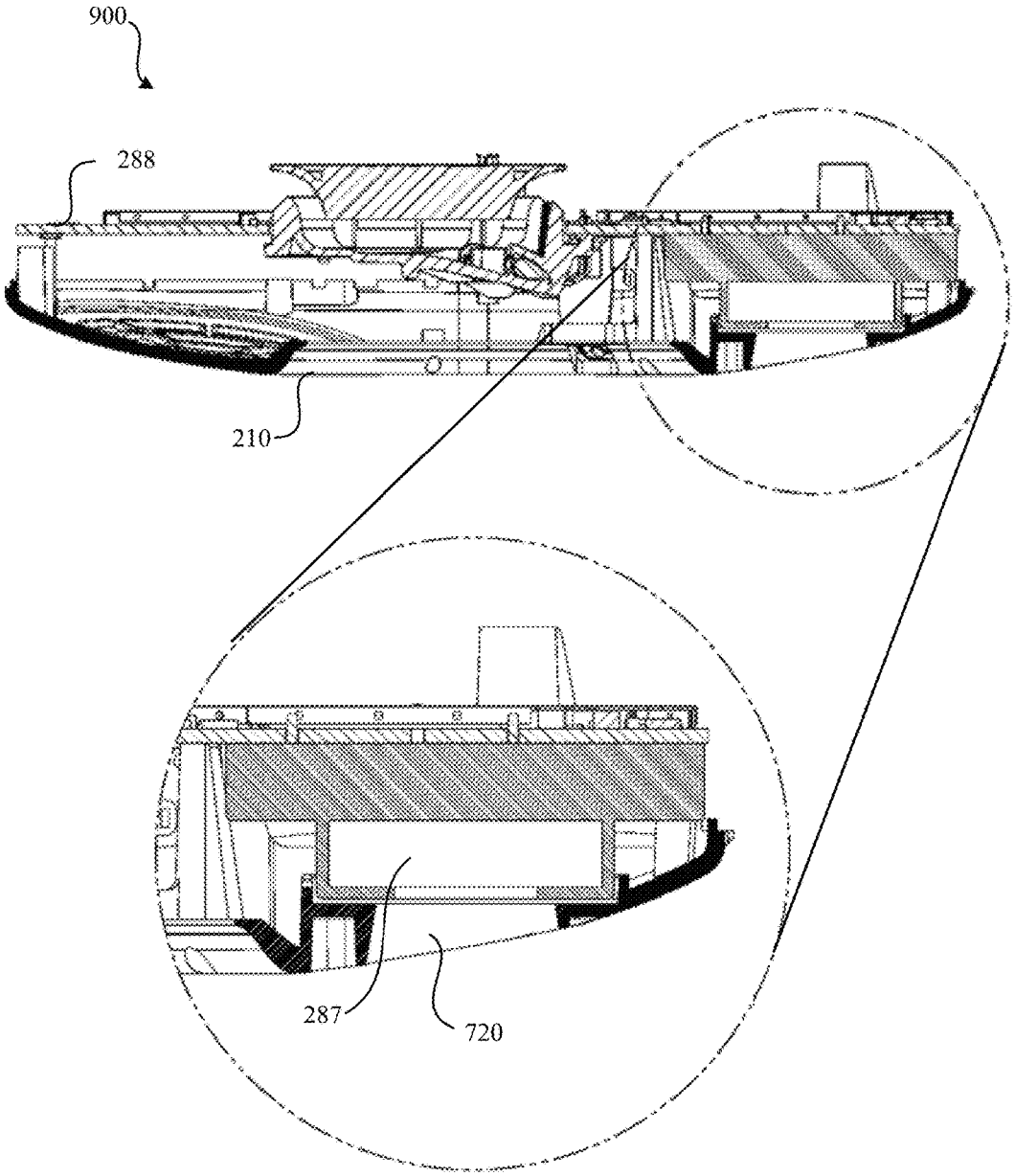
FIG. 9 illustrates an embodiment of a detailed portion of a cross section of a buzzer.

FIG. 9 illustrates an embodiment of a detailed portion of a cross section of a buzzer (e.g., buzzer 287) included in the configuration of FIGS. 7A-7D as connected to a chassis (e.g., main chassis 210). Device 900 may represent an alternate view of devices 700A-700D. It should be understood that alternate embodiments of device 900 may include a greater number of components or fewer components than presented in FIGS. 2C, 2D, and 7A-7D. Device 900 may include: main circuit board 288, main chassis 210, buzzer 287, and buzzer interface 720. In at least one embodiment, buzzer interface 720 of FIGS. 7A and 7B may receive a portion of buzzer 287. For example, a top ring of buzzer 287 may be partially inserted in buzzer interface 720 such that buzzer interface 720 extends a distance (e.g., 1.5 mm) over the top ring of buzzer 287. In accordance with at least one embodiment, upon activation of buzzer 287, sounds emitted from buzzer 287 may be projected outward from device 900 utilizing buzzer interface 720. Thus, in some cases, the sound emitted by buzzer 287 may be amplified. For example, sound emitted by buzzer 287 may be amplified by buzzer interface 720 so as to be 3-12 decibels louder than the sound emitted by buzzer 287 without utilizing buzzer interface 720.

Figure 10A:
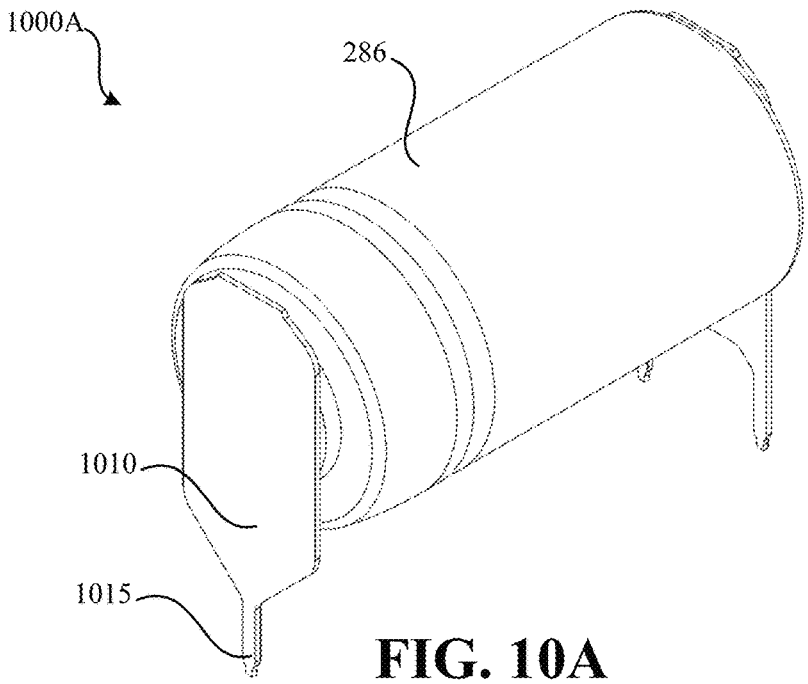
FIGS. 10A and 10B illustrate angled views of an embodiment of a carbon monoxide detector.
Figure 10B:
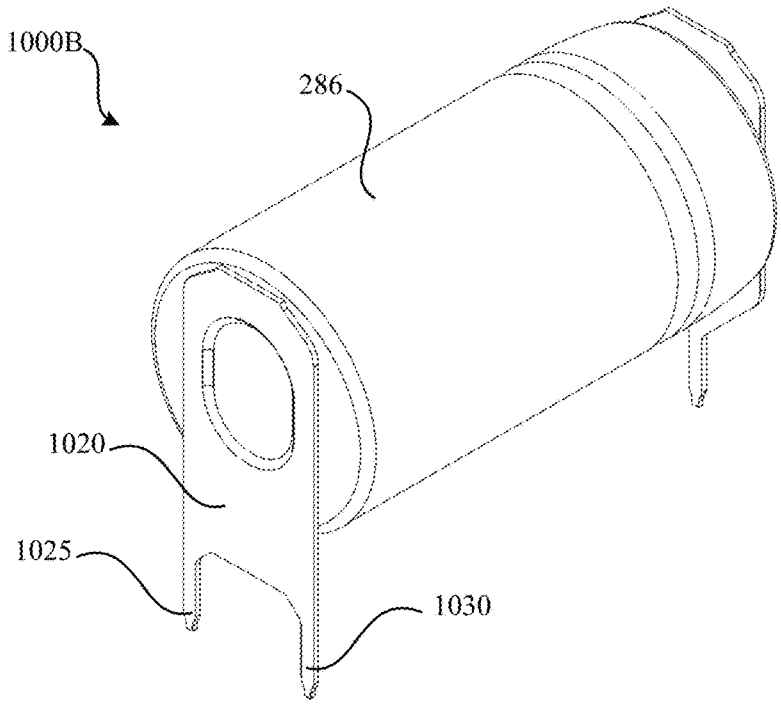

FIGS. 10A and 10B illustrate angled views of an embodiment of a carbon monoxide detector. Devices 1000A and 1000B may represent an alternate view of CO sensor 286 of FIGS. 2C, 2D, and 3A-3E. It should be understood that alternate embodiments of devices 1000A and 1000B may include a greater number of components or fewer components than presented in FIGS. 2C, 2D, and 3A-3E. Device 1000A may include: CO sensor 286 and mounting bracket 1010. Device 1000B depicts a reverse view of CO sensor 286 and may include CO sensor 286 and mounting bracket 1020. In accordance with at least one embodiment, CO sensor 286 may be attached at one end to mounting bracket 1010. Mounting bracket 1010 may have a single pin 1015. Mounting bracket 1020 may be attached to an opposing end of the CO sensor 286 with respect to mounting bracket 1010. Mounting bracket 1010 may have a first pin 1025 and a second pin 1030. It should be understood that a number of configurations suitable for CO sensor 286 and mounting brackets 1010 and 1020 may exist.

Figures 11A, 11B:
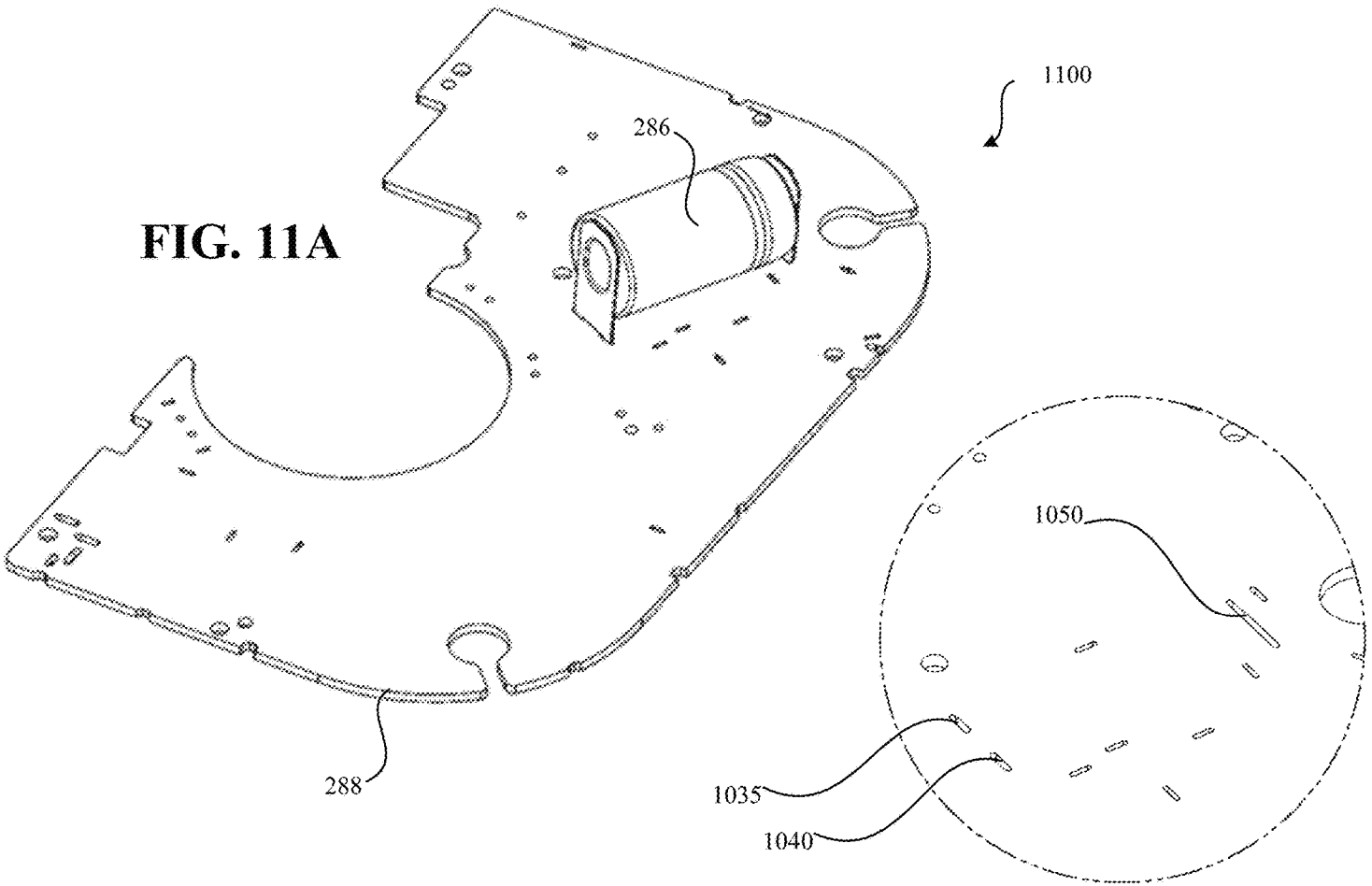
FIGS. 11A and 11B illustrate an embodiment of a configuration of the carbon monoxide detector on the printed circuit board.

FIGS. 11A and 11B illustrates an embodiment of a configuration of a carbon monoxide detector (e.g., CO sensor 286) on a printed circuit board (e.g., main circuit board 288). FIG. 11A illustrates CO sensor 286 as attached to main circuit board 288 of FIGS. 2C, 2D, and 3A-3E. FIG. 11B depicts a magnified view of a number of cutouts located on main circuit board 288. Referring back to FIG. 3C, in accordance with at least one embodiment, an edge of cutout 1030 may be located on main circuit board 288 at a distance of 47.82-48.12 mm (e.g., 47.97 mm) from left guide 319 and 39.18-39.48 mm (e.g., 39.33 mm) from bottom guide 317. Cutout 1030 may be 2.8 mm long and 0.6 mm wide, for example. An edge of cutout 1040 may be located at a distance of 50.54-50.84 mm (e.g., 50.69 mm) from left guide 319 and 44.76-45.06 mm (e.g., 44.91 mm) from bottom guide 317. Cutout 1040 may be 2.8 mm long and 0.6 mm wide, for example. An edge of cutout 1050 may be located at a distance of 22.75-23.05 mm (e.g., 22.9 mm) from left guide 319 and 52.91-53.21 mm (e.g., 53.06 mm) from bottom guide 317. Cutout 1040 may be 6.31 mm long and 0.6 mm wide, for example.

Figure 12A:
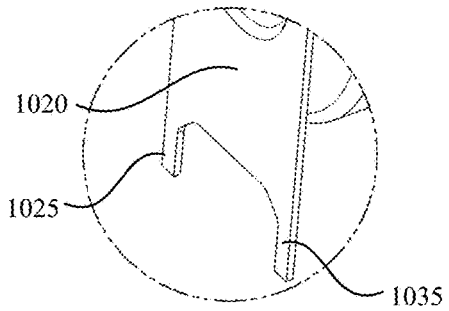
FIGS. 12A-12F illustrate an embodiment of a mounting bracket for the carbon monoxide detector.
Figure 12B:
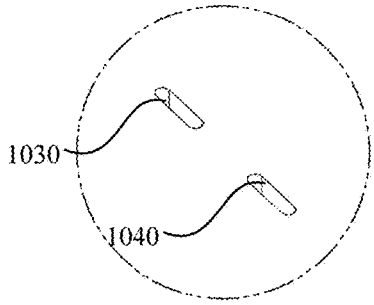
Figure 12C:
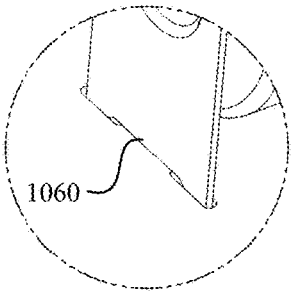

FIGS. 12A-12F illustrate an embodiment of a mounting mechanism for the carbon monoxide detector of FIGS. 10A, 10B, 11A, and 11B. FIGS. 12A-12C depict an example embodiment for attachment of a CO sensor 286 to main circuit board 288 using mounting bracket 1020. FIG. 12A depicts a magnified view of mounting bracket 1020 having a first pin 1025 and a second pin 1030. Cutouts 1030 and 1040 may be located on the main circuit board 288 as depicted in FIG. 11B. Upon mounting the CO sensor 286 on main circuit board 288, the first pin 1025 of FIG. 12A may be inserted and received by cutout 1030 of FIG. 12B. Substantially at the same time, the second pin 1035 of FIG. 12A may be inserted and received by cutout 1040 of FIG. 12B. FIG. 12C depicts a magnified view of mounting bracket 1020 being fully inserted and received by cutout 1040. In at least one example, an attachment mechanism (e.g., solder) may be utilized to affix mounting bracket 1020 to main circuit board 288 at location 1060. In one example, solder may be used to affix pins 1020 and 1025 to a reverse side of main circuit board 288 (e.g., the side of main circuit board 288 depicted in FIG. 3B).

Figure 12D:
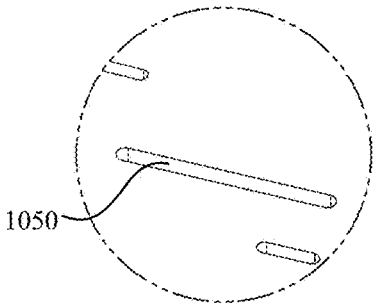
Figure 12E:
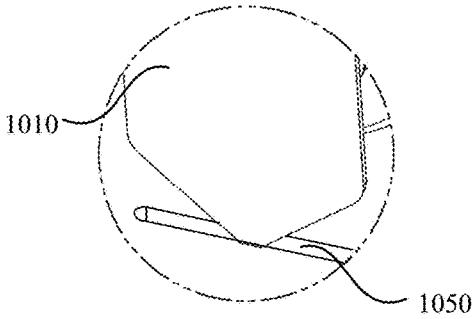
Figure 12F:
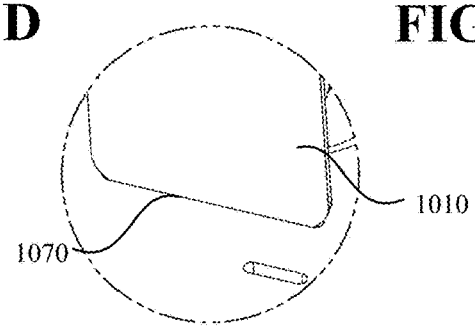

FIGS. 12D-12F each depict another example embodiment of an attachment of CO sensor 286 to main circuit board 288 using mounting bracket 1010. FIG. 12D depicts a magnified view of cutout 1050 of FIGS. 11A and 11B. Cutout 1050 may be located on the main circuit board 288 as depicted in FIGS. 11A and 11B. Upon mounting the CO sensor 286 on main circuit board 288, single pin 1015 of FIG. 11B may be inserted and received by cutout 1050 of FIG. 11B. Cutout 1050 may be located on the main circuit board 288 as depicted in FIG. 11B. Upon mounting the CO sensor 286 on main circuit board 288, single pin 1015 of FIG. 12B (obscured) may be inserted and received by cutout 1050 of FIG. 12E. In at least one example, single pin 1015 of FIG. 11B may be inserted into cutout 1050 at substantially the same time as insertion of first pin 1025 and second pin 1035 into cutout 1040 of FIG. 12A. FIG. 12F depicts a magnified view of mounting bracket 1010 being fully inserted and received by cutout 1050. In at least one example, an attachment mechanism (e.g., solder) may be utilized to affix mounting bracket 1050 to main circuit board 288 at location 1070. In one example, solder may be used to affix pin 1015 to a reverse side of main circuit board 288 (e.g., the side of main circuit board 288 depicted in FIG. 3B).

Figure 13B:
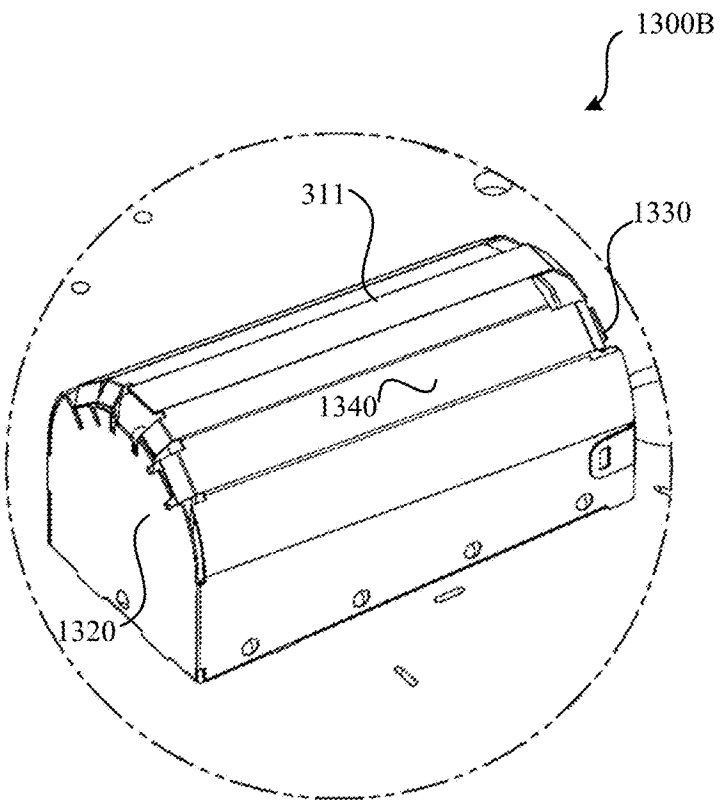
FIGS. 13A and 13B illustrate an angled view of an embodiment of a metallic covering for the carbon monoxide detector.
Figure 13A:
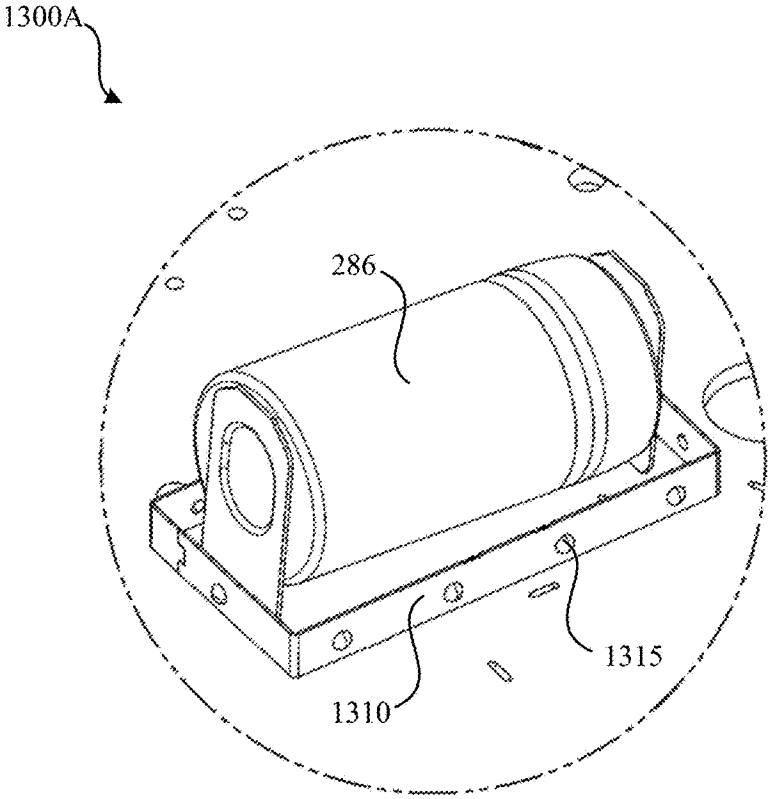

FIGS. 13A and 13B illustrate angled views of an embodiment of a metallic covering for the carbon monoxide detector of FIGS. 10A and 10B. It should be understood that alternate embodiments of devices 1300A and 1300B may include a greater number of components or fewer components than presented in FIGS. 2C, 2D, and 3A-3E. Device 1300A may include: CO sensor 286 and conductive strip 1310. Conductive strip 1310 may include any material suitable for dispersing electrical charge. Conductive strip may provide a rectangular structure around CO sensor 286 as depicted in FIG. 13A, though a rectangular structure is not required. Conductive strip 1310 may create any suitable shape around CO sensor 286. In at least one embodiment, one end of conductive strip 1310 may be connected to the opposite end of conductive strip 1310. One or more protrusions (e.g., protrusion 1315) may extend from conductive strip 1310. In a non-limiting example, FIG. 13A depicts several button-like protrusions, including protrusion 1315. If multiple protrusions are utilized, the protrusions may be evenly or unevenly spaced around conductive strip 1310.

In at least one embodiment, device 1300B may include: CO sensor 286 (not visible), conductive strip 1310 (not visible), and faraday cage cap 311. Faraday cage cap 311 may be the same material, or a similar material as conductive strip 1310. Faraday cage cap 311 may include any material suitable for dispersing electrical charge. In at least one example, faraday cage cap 311 may have a perimeter that is slightly larger than a perimeter of conductive strip 1310 of FIG. 13A. For example, faraday cage cap 311 may be 0.1 mm wider and longer than the conductive strip depicted in FIG. 13A. Faraday cage cap 311 may provide a dome structure around CO sensor 286 such that two opposing ends of the faraday cage cap 311 include straight walls (e.g., straight wall 1320 and straight wall 1330, while another side provides a domed wall as depicted in FIG. 13B, The domed wall may include a smooth surface provided by a single piece of material or multiple pieces of material. As a non-limiting example, CO sensor 286 may include one or more metallic panels (e.g., metallic panel 1340) that may be arranged so as to form a domed wall covering the CO sensor 286 (obscured). It should be understood that a domed wall is not necessarily included in the faraday cage cap 311, any suitable shape may be utilized.

In accordance with at least one embodiment, straight wall 1320 may be the same or different height as straight wall 1330. For example, straight wall 1320 may be taller than straight wall 1320.

Figure 14:
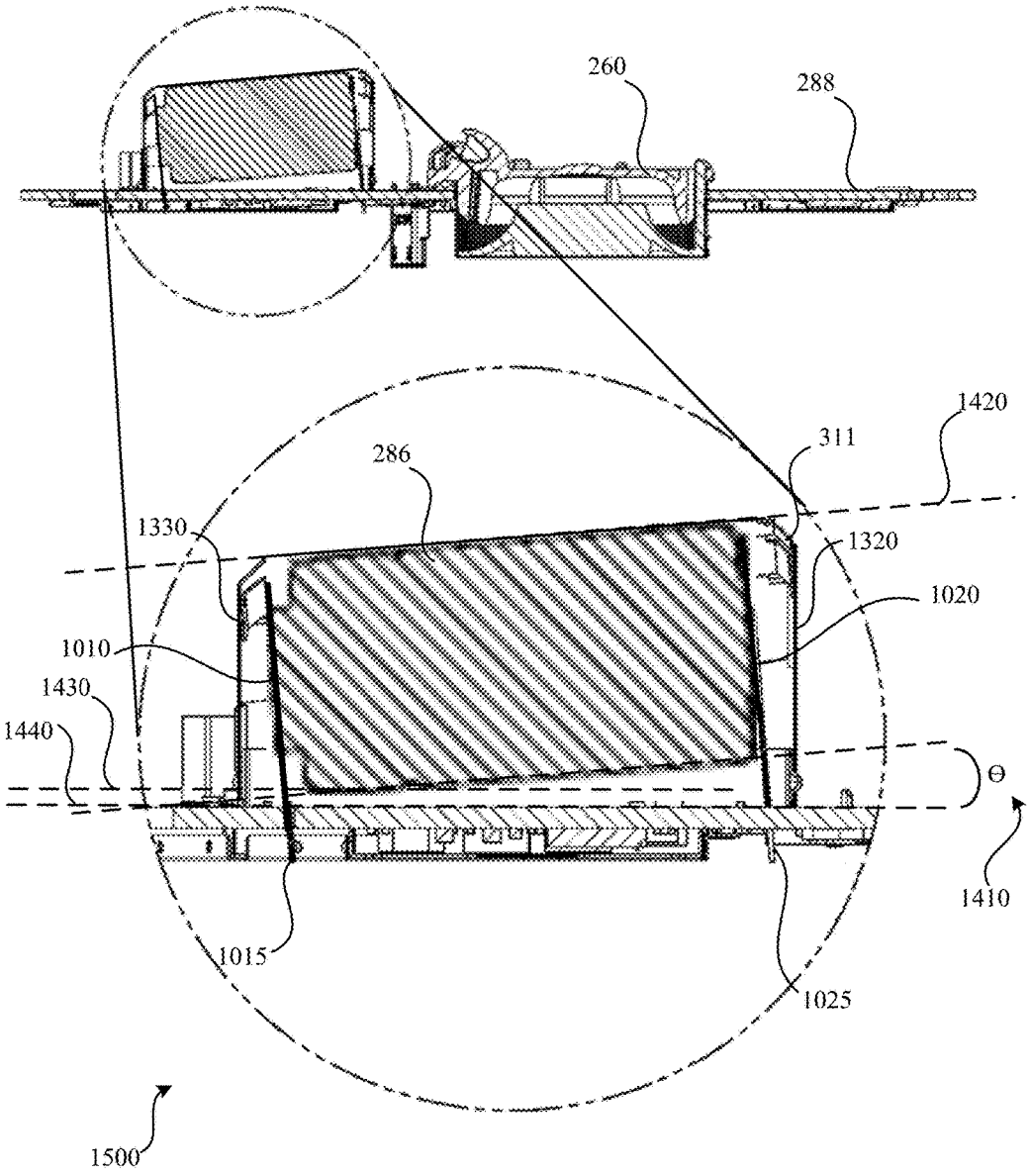
FIG. 14 illustrates a detailed portion of a cross section of the carbon monoxide detector.

FIG. 14 illustrates a detailed portion of a cross section of the carbon monoxide detector of FIGS. 10A and 10B as attached to a printed circuit board. Device 1400 represents an alternate view of CO sensor 286 of FIGS. 2C, 2D, 3A-3E, 10A, 10B, 11A, and 13B. It should be understood that alternate embodiments of device 1400 may include a greater number of components or fewer components than presented in FIGS. 2C, 2D, 3A-3E, 10A, 10B, 11A, and 13B. Device 1400 depicts a detailed portion of CO sensor 286 as attached to main circuit board 288 in accordance with at least one embodiment. Device 1400 may include: CO sensor 286, smoke chamber 260, faraday cage cap, 311, straight wall 1320, straight wall 1330, mounting bracket 1010, mounting bracket 1020, single pin 1015, a first pin 1025, and acute angle 1410. In accordance with at least one embodiment, CO sensor 286 may be mounted in such a way as to form an acute angle (e.g., the acute angle 1410) with respect to the main circuit board 288. For example, CO sensor 286 may be mounted to mounting bracket 1010 and mounting bracket 1020 as depicted in FIGS. 10A and 10B. CO sensor 286 may be attached to main circuit board 288 in a manner described in FIGS. 12A-12F. In at least one example, CO sensor 286 may be tilted to form acute angle 1410 with respect to main circuit board 288 as depicted in FIG. 14. In accordance with at least one embodiment, acute angle 1410 may range from a 3.5 degree angle to a 5 degree angle (e.g., 4.5 degree angle) with respect to main circuit board 288. Continuing on with the current example, straight wall 1320 may be designed to be taller than straight wall 1330 such that a ceiling portion of faraday cage cap 311 is tilted (e.g., at acute angle 1410 with respect to the main circuit board 288). In at least some examples, straight wall 1320 may range from 15.98-16.88 mm (e.g., 16.48 mm) high. A bottom-most point of CO sensor 286 (indicated by guide 1430) may be a distance of 0.24-1.04 mm (e.g., 0.64 mm) from a top surface of main circuit board 288 (indicated by guide 1440). In at least some examples, both the CO sensor 286 and a ceiling portion of the faraday cage cap 311 may be tilted so as to be parallel to guide line 1420.

In accordance with at least one embodiment, CO sensor 286 and faraday cage cap 311 may be tilted according to an acute angle (e.g., acute angle 1410) that will enable clearance by CO sensor 286 and faraday cage cap 311 of an interior height limit of main chassis 210 (e.g., a height limit in accordance with the aperture of FIG. 7A). As a non-limiting example, a height limit of 6.9 mm may correspond to a depth of an aperture of, for example, main chassis 210. Thus, in such an example, components mounting on the printed circuit board (e.g., main circuit board 288), and/or being housed between main chassis 210 and main circuit board 288, may necessarily be less than 15 mm high, for example, with respect to the circuit board. In at least one embodiment, an acute angle (e.g., the acute angle 1410) may be formed between CO sensor 286 and main circuit board 288 by partially depressing one or more mounting points of the CO sensor 286 into a cutout in the main circuit board 288. In some cases, a gap between the main chassis 210 and the main circuit board 288 decreases at points approaching a shared edge of the main chassis 210 and the main circuit board 288 according to a taper of the inner portion. Thus, components nearer to the shared edge may necessarily have a different height limit (e.g., 6.9 mm) in accordance with the taper of the inner portion.

Figure 15A:
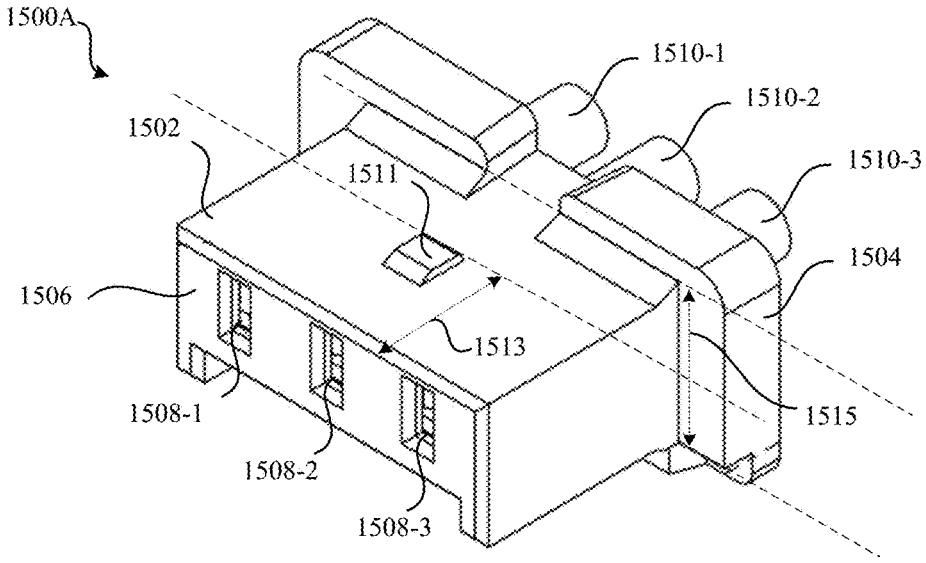
FIGS. 15A and 15B illustrate an angled view and a top view respectively of an embodiment of a custom connector plug.
Figure 15B:
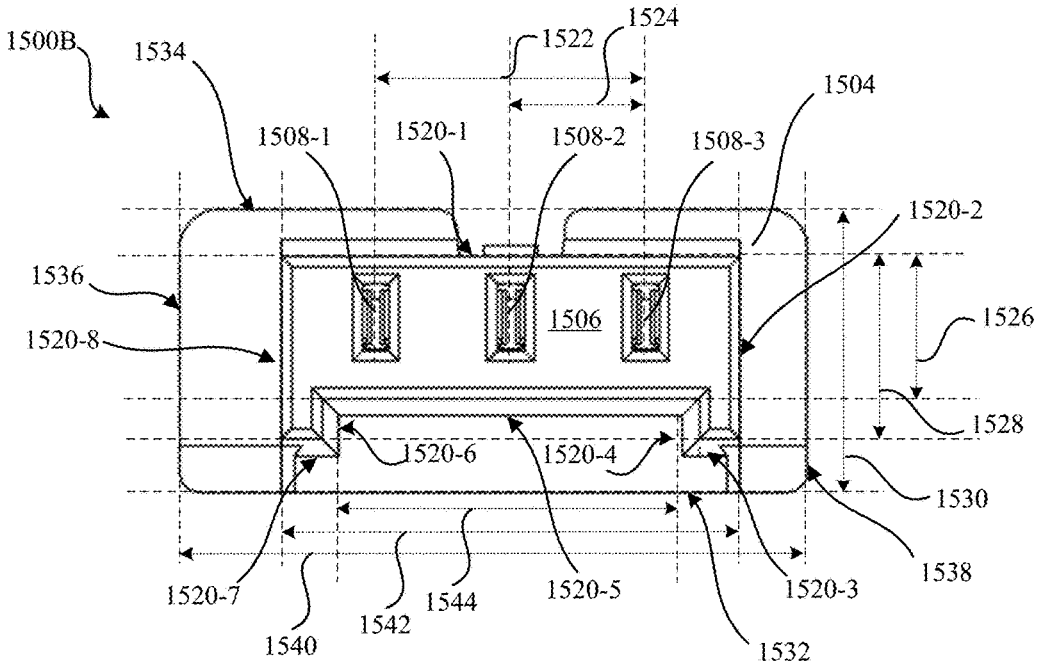

FIGS. 15A and 15B illustrate an angled view and a top view, respectively, of an embodiment of a custom connector plug. In an embodiment, a smart combined smoke detector and carbon monoxide detector includes a custom connector plug 1500A that receives electrical power for operating the hazard detector from an electronic source (e.g., batteries). It should be understood that although the connector described below is designed as an alternating-current (AC) connector, the construction and operational principles would apply equally to a connector for direct-current (DC) external power.

In an embodiment, the custom connector plug 1500A includes a plug body 1502 having eight lateral walls, each of the eight lateral walls adjoining two others of the lateral walls, and the bottom wall 1506, continuously and airtightly along edges thereof, forming a plug cavity. The plug body 1502 forms a flange 1504 along edges of the lateral walls that are furthest from the bottom wall 1506. The plug body 1502 further includes a plurality of electrical pin sockets (e.g., 1508-1, 1508-2, and 1508-3, collectively referred to herein as electrical pin sockets 1508), that pass through the bottom wall 1506 of the plug body 1502, such that first ends of each of the electrical pin sockets 1508 terminate at bottom wall 1506, and opposing ends of each of the electrical pin sockets 1508 extend away from a bottom wall 1506 of the plug body 1502.

Features that are described above and are visible in the views of plug 1500B include plug body 1502, flange 1504, bottom wall 1506, electrical pin sockets 1508, wire 1510-1, wire 1510-2, and wire 1510-3 (collectively referred to herein as wires 1510), and protrusion 1511. Features that are described above and are visible in the views of plug 1500B flange 1504, bottom wall 1506, electrical pin sockets 1508, lateral wall 1520-1, lateral wall 1520-2, lateral wall 1520-3, lateral wall 1520-4, lateral wall 1520-5, lateral wall 1520-6, lateral wall 1520-7, lateral wall 1520-8 (collectively referred to herein as lateral walls 1520, outer flange wall 1532, outer flange wall 1534, outer flange wall 1536, and outer flange wall 1538.

In accordance with at least one embodiment, wires 1510 may include 22 American Wire Gauge wires. A distance 1513 between bottom wall 1506 and a top edge of protrusion 1511 may measure 2.6 mm. A distance 1515 may measure 2.86 mm.

In accordance with at least one embodiment, a distance 1522 between a center of electrical pin socket 1508-1 and a center of electrical pin socket 1508-3 may measure 4 mm. A distance 1524 between a center of electrical pin socket 1508-2 and either electrical pin socket 1508-1 or electrical pin socket 1508-3 may measure 2 mm. A distance 1526 between lateral wall 1520-1 and lateral wall 1520-5 may measure 2.1 mm. A distance 1528 between lateral wall 1520-5 and lateral wall 1520-3 may measure 2.7 mm. A distance 1530 between lateral wall 1520-5 and lateral wall 1520-3 may measure 4.2 mm. A distance 1540 between outer flange wall 1536 and outer flange wall 1538 may measure 9.3 mm. A distance 1542 between lateral wall 1520-8 and lateral wall 1520-2 may measure 6.8 mm. A distance 1544 between lateral wall 1520-6 and lateral wall 1520-4 may measure 5.6 mm.

Figure 15C:
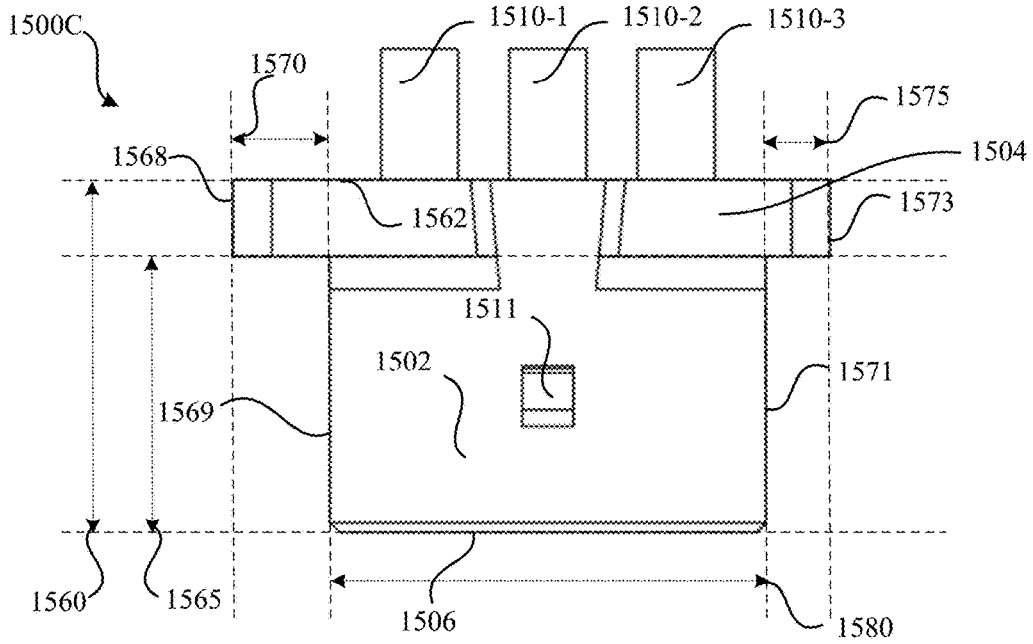
FIGS. 15C and 15D illustrate side views of an embodiment of the custom connector plug.
Figure 15D:
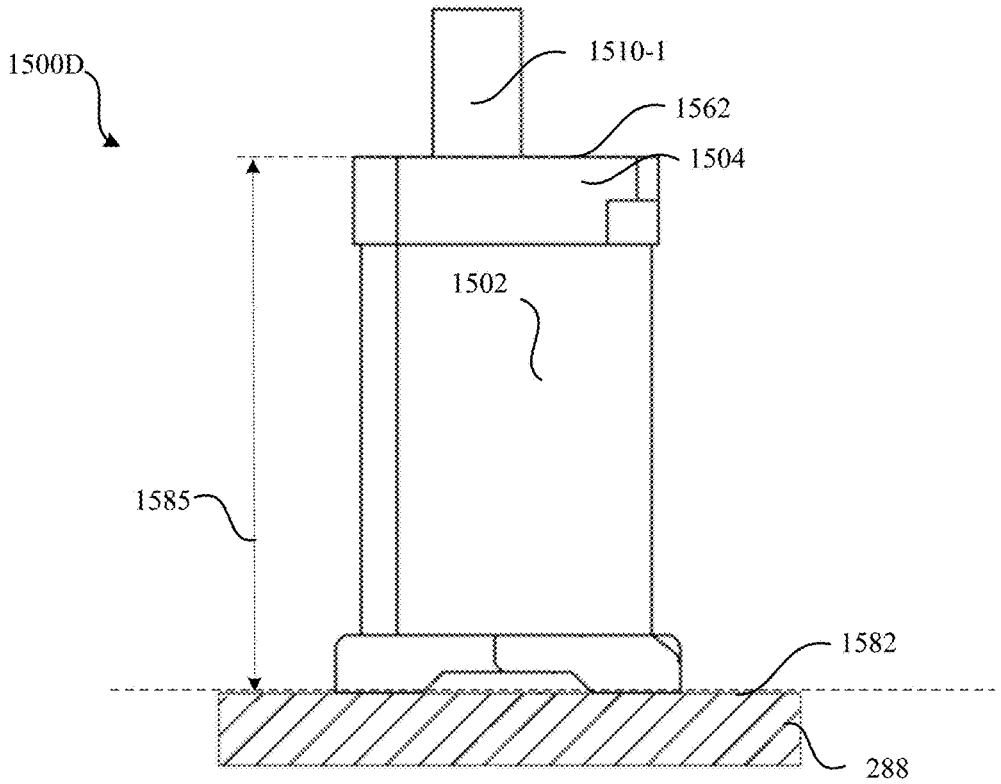

FIGS. 15C and 15D illustrate side views of an embodiment of the custom connector plug of FIGS. 15A and 15B. Features that are described above and are visible in the views of plug 1500C include plug body 1502, flange 1504, bottom wall 1506, wires 1510, and protrusion 1511. A distance 1560 between a top wall 1562 of flange 1504 and bottom wall 1506 may measure 5.5 mm. A distance 1565 between a bottom wall of flange 1504 and bottom wall 1506 may measure 4.3 mm. A distance 1570 between outer flange wall 1568 and a lateral wall 1569 of plug body 1502 may measure 1.5 mm. A distance 1575 between lateral wall 1571 and outer flange wall 1573 may measure 1.0 mm. A distance 1580 between lateral wall 1569 and lateral wall 1571 may measure 6.8 mm. Features that are described above and are visible in the views of plug 1500D include plug body 1502, flange 1504, wires 1510, and main circuit board 288 of FIGS. 2C, 2D, and 3A-3D. A distance 1585 between top wall 1562 of flange 1504 may measure 7.4 mm.

Figure 16A:
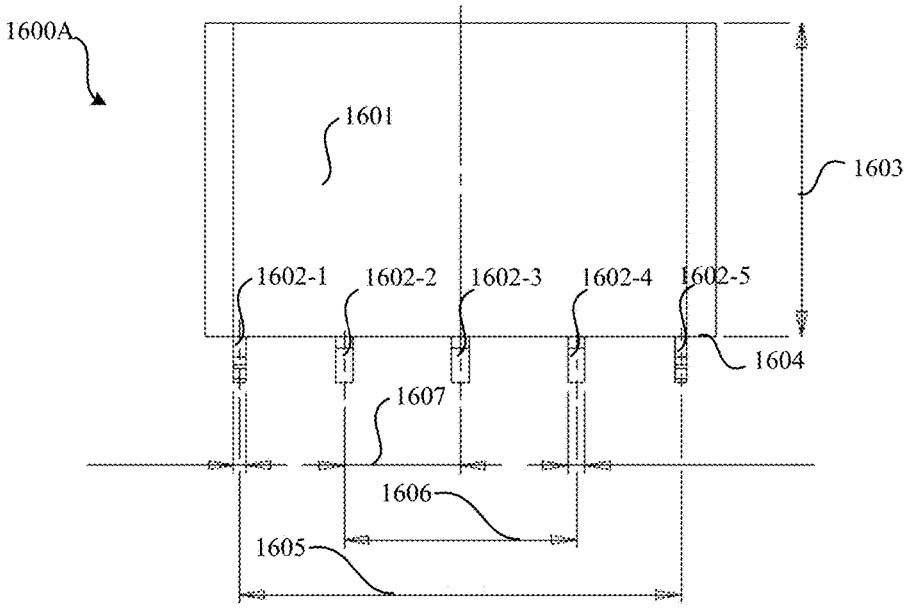
FIGS. 16A and 16B illustrate side views of an embodiment of the custom connector socket.

FIG. 16A illustrates a side view of an embodiment of the custom connector socket. In an embodiment, a smart combined smoke detector and carbon monoxide detector includes a custom connector plug 1600A that receives electrical power for operating the hazard detector from an electronic source (e.g., batteries). In an embodiment, the custom connector plug 1600A includes a plug body 1601 having four lateral walls, each of the four lateral walls adjoining two others of the lateral walls, and a bottom wall 1506. Custom connector plug 1600A may include eight electrical pins (1602-1 to 1602-5 shown, 1602-6 to 1602-8 obscured).

In accordance with at least one embodiment, a height of custom connector plug 1600A may be equal to distance 1603 (e.g., 5.4 mm). A distance 1605 between a center of electrical pin 1602-1 and a center of electrical pin 1602-5 may measure 1.0 mm. A distance 1606 between a center of electrical pin 1602-2 and a center of electrical pin 1602-4 may measure 4.0 mm. A distance 1607 between a center of electrical pin 1602-2 and a center of electrical pin 1602-3 may measure 2.0 mm.

Figure 16B:
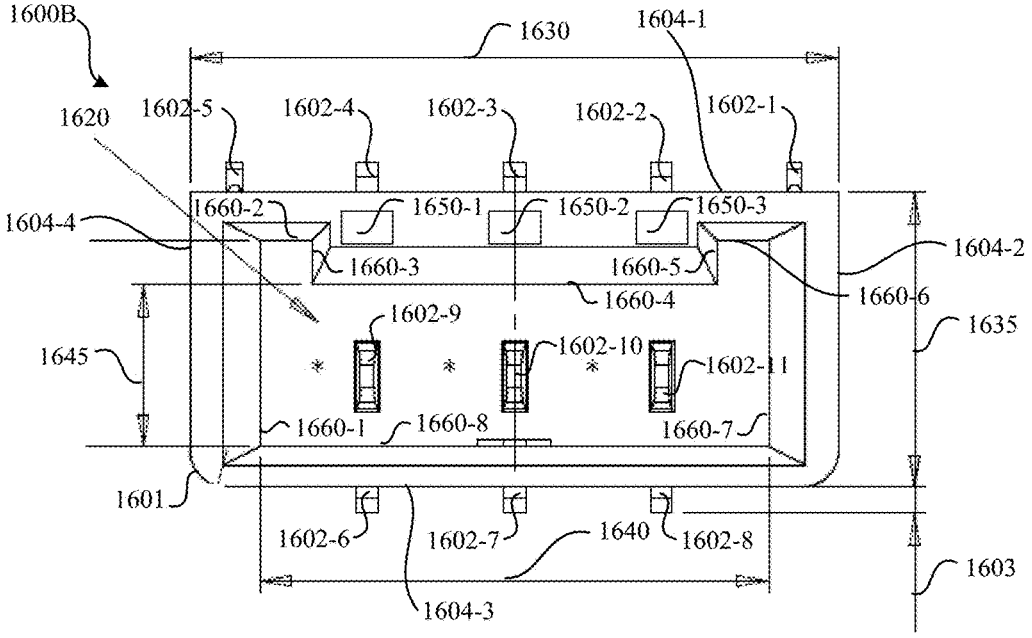

FIG. 16B illustrates a top view of an embodiment of the custom connector socket of FIG. 16A. Features that are described above and are visible in the views of plug 1600B include plug body 1601, rear wall 1620, electrical pins 1602-1 through 1602-8, electrical pins 1602-9 through 1602-11, recess 1650-1, recess 1650-2, recess 1650-3, outer lateral walls 1604-1, 1604-2, 1604-3, 1604.4, and interior lateral walls 1660-1 through 1660-8. A distance 1630 between outer lateral wall 1604-4 and outer lateral wall 1604-2 may measure 8.8 mm. A distance 1635 outer lateral wall 1604-1 and outer lateral wall 1604-3 may measure 4 mm. A distance 1640 interior lateral wall 1660-4 and interior lateral wall 1660-8 may measure 6.9 mm. A distance 1645 interior lateral wall 1660-4 and interior lateral wall 1660-8 may measure 2.2 mm.

Figure 17:
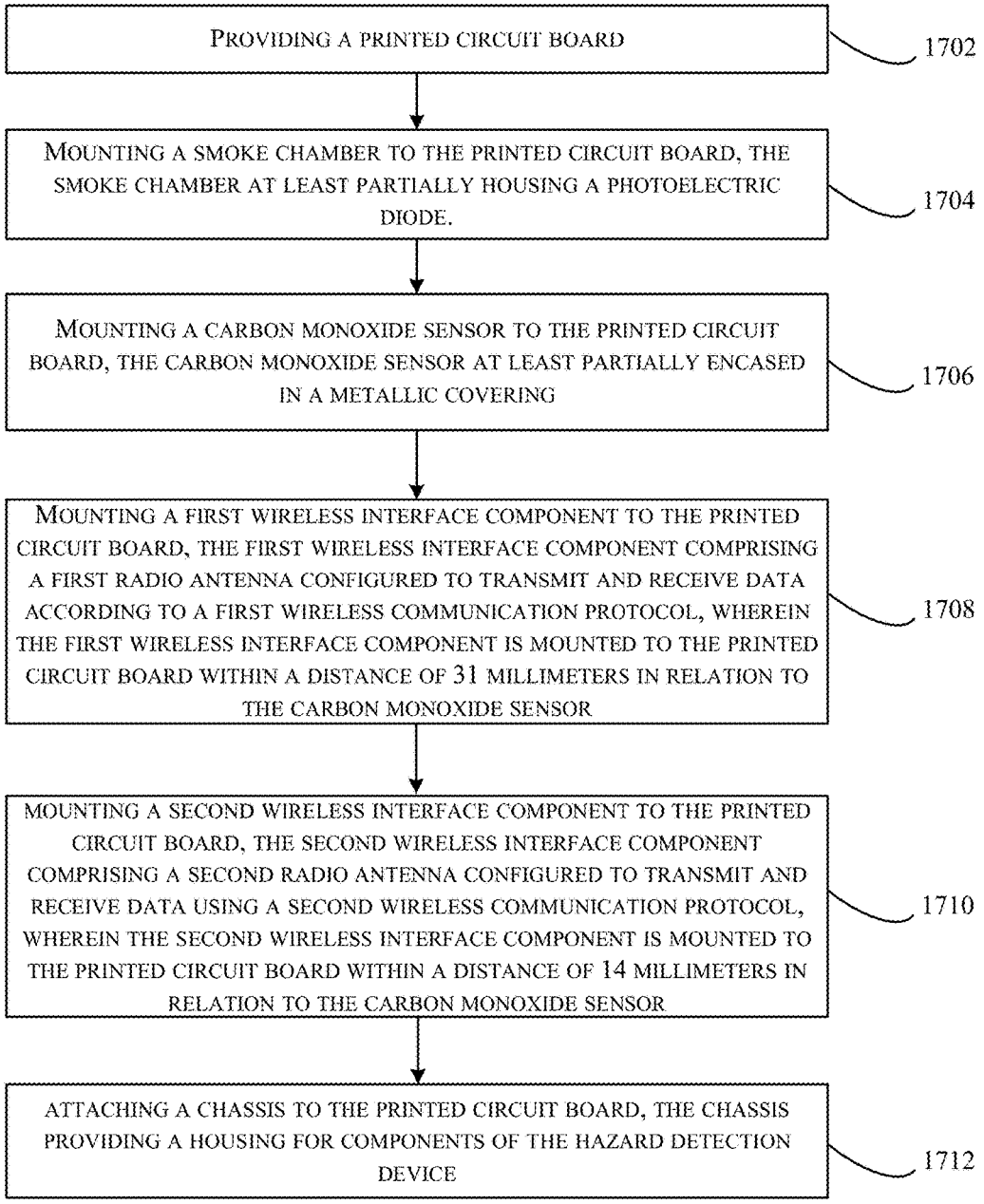
FIG. 17 illustrates a block diagram for a method of manufacturing a hazard device, in accordance with one embodiment.

FIG. 17 illustrates a block diagram 1700 for a method of manufacturing a hazard device, in accordance with one embodiment. At block 1702, a printed circuit board may be provided. At block 1704, a smoke chamber may be mounted to the printed circuit board, the smoke chamber at least partially housing a photoelectric diode. At block 1706, a carbon monoxide sensor may be mounted to the printed circuit board, the carbon monoxide sensor at least partially encased in a metallic covering. At block 1708, a first wireless interface component may be mounted to the printed circuit board, the first wireless interface component comprising a first radio antenna configured to transmit and receive data according to a first wireless communication protocol, the first wireless interface component being mounted to the printed circuit board within a distance range of 25-35 millimeters in relation to the carbon monoxide sensor. At block 1710, a second wireless interface component may be mounted to the printed circuit board, the second wireless interface component comprising a second radio antenna configured to transmit and receive data using a second wireless communication protocol, the second wireless interface component being mounted to the printed circuit board within a distance range of 10-15 millimeters in relation to the carbon monoxide sensor. At block 1712, a chassis may be attached to the printed circuit board, the chassis providing a housing for components of the hazard detection device.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A hazard detector, comprising:

a chassis;

a circuit board mounted within the chassis;

an electromagnetic sensor; and a smoke chamber mid-mounted on the circuit board within the chassis such that air passes into the smoke chamber from a first side of the circuit board and the electromagnetic sensor that senses smoke within the smoke chamber is mounted on a second side of the circuit board.

2. The hazard detector of claim 1, further comprising a first metallic shielding and a second metallic shielding, wherein the first metallic shielding and the second metallic shielding are positioned on an exterior of the smoke chamber that is mid-mounted with the circuit board.

3. The hazard detector of claim 2, wherein the first metallic shielding comprises a mesh that permits air to pass through the mesh into the smoke chamber.

4. The hazard detector of claim 1, further comprising a speaker assembly, the speaker assembly comprising a speaker and a speaker box, wherein:

the speaker box comprising a first box section, a second box section, and a cone section, wherein the first box section, the second box section, and the cone section generally form an L shape; and the speaker box partially encircles the smoke chamber that is mid-mounted on the circuit board.

5. The hazard detector of claim 4, wherein a curved exterior surface of the speaker assembly partially encircles the smoke chamber.

6. The hazard detector of claim 4 wherein the speaker assembly is positioned on the second side of the circuit board.

7. The hazard detector of claim 4 wherein the speaker of the speaker assembly, is positioned at an angle to the circuit board.

8. The hazard detector of claim 7, wherein the chassis is domed and the speaker being positioned at the angle within the speaker box facilitates positioning of the speaker assembly within the domed chassis.

9. The hazard detector of claim 4 wherein the speaker box further comprises a protrusion that at least partially overlaps a portion of the smoke chamber that is mid-mounted.

10. The hazard detector of claim 4 wherein a plurality of foam pads are mounted to an exterior of the speaker box.

11. The hazard detector of claim 4 the speaker box further comprising a protrusion to be inserted through a cutout of the circuit board.

12. The hazard detector of claim 1 further comprising a carbon monoxide sensor mounted with the circuit board such that an acute angle is formed between the circuit board and the carbon monoxide sensor.

13. The hazard detector of claim 12, wherein the chassis is domed and the acute angle facilitates mounting of the carbon monoxide sensor to the circuit board within the domed chassis.

14. A method for manufacturing a hazard detector, comprising:

mounting a smoke chamber with a printed circuit board, wherein the smoke chamber is mid-mounted with the circuit board to be placed within a chassis such that air passes into the smoke chamber from a first side of the circuit board and an electromagnetic sensor that senses smoke within the smoke chamber is mounted on a second side of the circuit board; and attaching the printed circuit board having the smoke chamber with the chassis that houses components of the hazard detector.

15. The method for manufacturing the hazard detector of claim 14, further comprising:

mounting a first metallic shielding and a second metallic shielding around the smoke chamber, wherein the first metallic shielding and the second metallic shielding are mounted around the smoke chamber that is mid-mounted with the circuit board.

16. The method for manufacturing the hazard detector of claim 14, further comprising:

mounting a speaker assembly within the chassis, the speaker assembly comprising a speaker and a speaker box, wherein:

the speaker box comprising a first box section, a second box section, and a cone section, wherein the first box section, the second box section, and the cone section generally form an L shape; and the speaker box partially encircles the smoke chamber that is mid-mounted with the circuit board.

17. The method for manufacturing the hazard detector of claim 16, further comprising:

mounting a carbon monoxide sensor mounted with the circuit board such that an acute angle is formed between the circuit board and the carbon monoxide sensor.

18. The method for manufacturing the hazard detector of claim 17, wherein the carbon monoxide sensor and the speaker assembly are proximate to the second side of the circuit board.

19. An optical hazard detector, comprising:

a housing means;

a circuit board means located within the housing means;

an electromagnetic sensing means; and a chamber means that is mid-mounted with the circuit board means within the housing means such that air passes into the chamber means from a first side of the circuit board means and the electromagnetic sensing means that senses smoke within the chamber means is mounted on a second side of the circuit board means.

20. The optical hazard detector of claim 19, further comprising:

an audio output means wherein the audio output means generally forms an L shape; and the audio output means partially encircles the chamber means that is mid-mounted with the circuit board means.

* * * * *